US006388690B1

(12) United States Patent
Kurachi

(10) Patent No.: US 6,388,690 B1
(45) Date of Patent: May 14, 2002

(54) THERMAL RECORDING APPARATUS

(75) Inventor: Katsuhito Kurachi, Kasugai (JP)

(73) Assignee: Brother Kogyo Kabushiki Kogyo, Nagoya (JP)

( * ) Notice: Subject to any disclaimer, the term of this patent is extended or adjusted under 35 U.S.C. 154(b) by 0 days.

(21) Appl. No.: 09/709,438

(22) Filed: Nov. 13, 2000

Related U.S. Application Data

(62) Division of application No. 09/160,335, filed on Sep. 25, 1998, now abandoned.

(30) Foreign Application Priority Data

Sep. 30, 1997 (JP) ..... 9-265869

(51) Int. Cl.[7] ..... B41J 2/325

(52) U.S. Cl. ..... 347/180; 347/41

(58) Field of Search ..... 347/182, 183, 347/180, 240, 251, 172, 40–43; 400/120.09

(56) References Cited

U.S. PATENT DOCUMENTS 4,675,700 A * 6/1987 Nagira et al. ..... 347/182
5,721,578 A * 2/1998 Nakai et al. ..... 347/183
5,765,876 A * 6/1998 Koike et al. ..... 347/43
5,961,227 A * 10/1999 Kurachi ..... 400/120.09
6,213,585 B1 * 4/2001 Kikuchi et al. ..... 347/41
6,288,735 B1 * 9/2001 Naramoto et al. ..... 347/172

* cited by examiner

*Primary Examiner*—N. Le
*Assistant Examiner*—K. Feggins
(74) *Attorney, Agent, or Firm*—Oliff & Berridge, PLC

(57) ABSTRACT

Every time after a cyan ink and a magenta ink are transferred to form respective color dots of a line with a length L2 in a sub-scanning direction, an ribbon cassette RC is returned to a start position of the transference of the cyan and magenta inks and moved by half of a pitch of a print dot of the cyan and magenta inks in the sub-scanning direction by a carriage moving mechanism CH. Subsequently, an yellow ink is transferred to form yellow color dots of a first column. Every time after the ribbon cassette RC is moved by a pitch P1 each in the sub-scanning direction, the yellow ink is transferred to form dots of one column until dots of all columns in the length L2 of a line are formed.

13 Claims, 12 Drawing Sheets

FIG. 9

10

| GRADARION LEVEL | 1 | 2 | 3 | 4 | 5 | 6 | 7 | 8 |
|---|---|---|---|---|---|---|---|---|
| THE NUMBER OF PULSES | 2 | 4 | 6 | 8 | 12 | 20 | 32 | 63 |

THERMAL RECORDING APPARATUS

This is a Division of application Ser. No. 09/160,335 filed Sep. 25, 1998 now abandoned. The entire disclosure of the prior application(s) is hereby incorporated by reference herein in its entirety.

BACKGROUND OF THE INVENTION

1. Field of the Invention

The present invention relates to a thermal recording apparatus which thermally transfers inks of different colors on a print medium by selectively driving a plurality of heating-elements mounted on a thermal head to generate heat. The invention more particularly relates to a thermal recording apparatus in which odd and even heating-elements are energized at different time points to transfer an ink of one color every time each of the odd and even heating-elements are alternately energized, in order to prevent overlap of the first color ink and the second color ink, and then the third color ink is transferred on the position displaced from the positions where the first and second color inks are transferred, so that the color inks are less overlapped each other to improve color-reproducibility, and the size of apparatus and the manufacturing cost are reduced.

2. Description of Related Art

There have been proposed various thermal recording apparatus to dissolve the problems such as the unevenness of density caused by a difference of transferring efficiency between inks and the mixing failure and fixing failure due to insufficient melted ink. Such the problems are caused when inks of different three colors, namely, cyan, magenta, and yellow are thermally transferred on a print medium by a thermal head so that heating-elements of the thermal head are energized by the same energy to thermally transfer the three color inks, overlapping one another.

For example, Japanese patent (JP) publication No. 3(1991)-54633 discloses a thermal transfer recording apparatus that is provided with a circuit for discriminating the recording history of a recording paper with a recorded picture element as a unit and a thermal head is controlled in accordance with the recording history to energize heating-elements to generate heat. The energy control is executed by the control of pulse width, duration of the power to be supplied to the heating-elements or voltage of the power, and the control of temperature of the thermal head. Accordingly, recording images transferred with uniform density can be obtained by the second and following thermal transfer recording, regardless of whether or not an ink is previously thermally transferred on the recording paper.

JP patent publication, No. 3(1991)-73471 discloses a multicolor thermal recording apparatus provided with means for setting the energy to be supplied to a thermal head for the n-th overlap recording to be larger than that for the (n−1)th recording. Concretely, the means sets the amount of energy to be supplied to the. thermal head for second overlap recording to be larger than that for the first recording, and the amount of energy for the third overlap recording to be larger than that for the second recording. Accordingly, the ink used for overlap recording can be melted in and mixed with the ink used before the overlap recording, improving mixability of the inks. Also, the ink used for the overlap recording can be saturated in the recording paper with the ink used before the overlap recording, so that the ink fixation can be enhanced.

However, the above thermal recording apparatus disclosed in JP publications Nos. 3-54633 and 3-73471 require to control the amount of energy to be supplied to each of the heating-elements of the thermal head every time the thermal transfer is performed, and to change the amount of energy according to temperature variations in an operating environment. This results in a complicated control circuit, a large-sized apparatus and an increase in manufacturing cost.

SUMMARY OF THE INVENTION

The present invention has been made in view of the above-circumstances and has an object to overcome the above problems and to provide a thermal recording apparatus capable of reducing the amount of overlapping of plural inks having different colors by simple control, of improving color-reproducibility, and of reducing the apparatus size and the manufacturing cost thereof by energizing odd and even heating-elements at different time points to transfer an ink of one color every time each of the odd and even heating-elements are energized so that the first and second color inks are transferred without overlapping each other, and then the third color ink is transferred in a position displaced from the positions of the first and-second color ink.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the purpose of the invention, there is provided a thermal recording apparatus including a thermal head provided with a plurality of heating-elements, the thermal head being movable in a first direction, a drive device for selectively driving the heating-elements to generate heat, an ink ribbon applied thereon with at least a first color ink and a second color ink, a print medium on which images are to be printed through the ink ribbon by the selected heating-elements, the print medium being fed in a second direction intersecting the first direction, means for dividing the heating-elements into a fist group of odd heating-elements and a second group of even heating-elements, and alternately driving the odd heating-elements and the even heating-elements at different time points, a memory for storing image data corresponding to the first color and image data corresponding to the second color, and control means for operating the drive device to drive one group of the first heating-element group and the second heating-element group to generate heat and, after moving the thermal head by one pitch defined by a print dot in the first direction, operating the drive device again to drive the other group of the first heating-element group and the second heating-element group to generate heat, thereby to print the first color ink on the print medium based on the image data, and for operating the drive device to drive the other group that is different from the one group driven first to print the first color ink thereby to print the second color ink on positions where the first color ink has been printed on the print medium.

In the above thermal recording apparatus according to the present invention, the heating-elements associated with odd dots to be printed and those associated with even dots are driven to generate heat at different time points. To thermally transfer an ink of the first color on a print medium based on the image data, a plurality of heating-elements out of one of the odd and even heating-elements are energized and, after the thermal head is moved by a printing pitch in the predetermined sub-scanning direction, a plurality of heating-elements out of the other of the odd and even heating-elements are energized. In this way, the odd and even heating-elements are alternately energized every time after the thermal head is moved by a printing pitch each.

Sequentially, to thermally transfer an ink of the second color, the odd or even heating-elements that differ from ones used for the thermal transference of the first color ink in a transference start position thereof are energized to generate heat, transferring the ink of the second color.

Accordingly, the first color ink and the second color ink are thermally transferred without overlapping each other, so that images with uniform density can be formed on the print medium. Since the energy to be supplied to a heating-element needs no controlling for respective heating-elements, each of the first and second color inks can be thermally transferred on the print medium by a simple control, enabling the reduction of the size and manufacturing cost of the apparatus. The first color ink and second color ink are thermally transferred in a staggered and latticed arrangement, thereby improving color-reproducibility due to an additive process. Furthermore, the alternate driving of the odd and even heating-elements can substantially prevent the influence of accumulation of heat on each of the heating-elements, which enables printing of color dots with a fine diameter.

BRIEF DESCRIPTION OF THE DRAWINGS

The accompanying drawings, which are incorporated in and constitute a part of this specification illustrate an embodiment of the invention and, together with the description, serve to explain the objects, advantages and principles of the invention.

In the drawings,

FIG. 4(*b*) is a plane view of FIG. 4(*a*);

FIG. 9 is a data table showing the relation between the gradation levels of print dots and the number of pulses of a pulse train in the first embodiment;

DETAILED DESCRIPTION OF THE PREFERRED EMBODIMENTS

A detailed description of a first to third preferred embodiments of a thermal recording apparatus embodying the present invention will now be given referring to the accompanying drawings.

Figure 1:
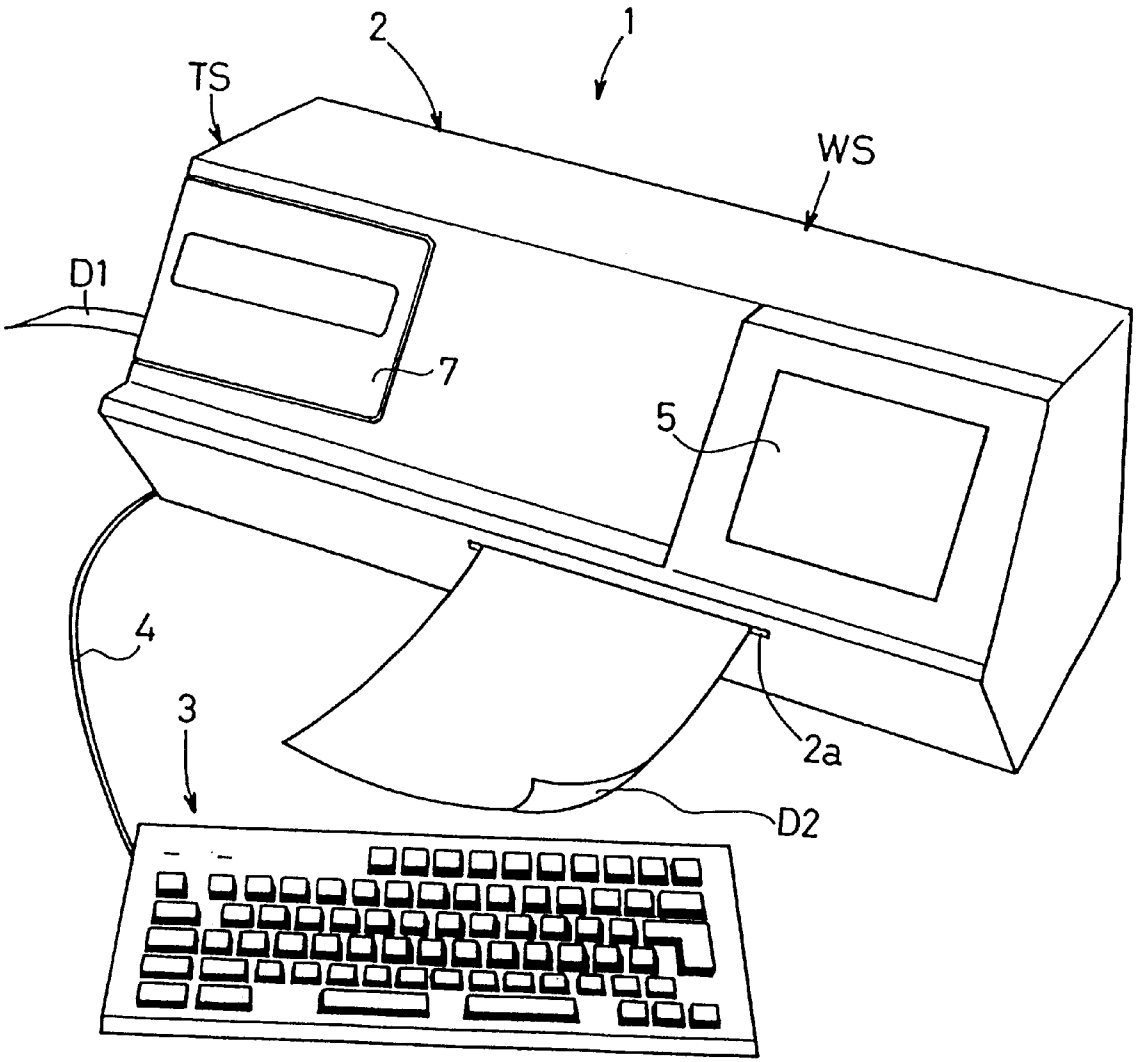
FIG. 1 is a perspective view of a thermal recording apparatus in a first embodiment according to the present invention.
Figure 2:
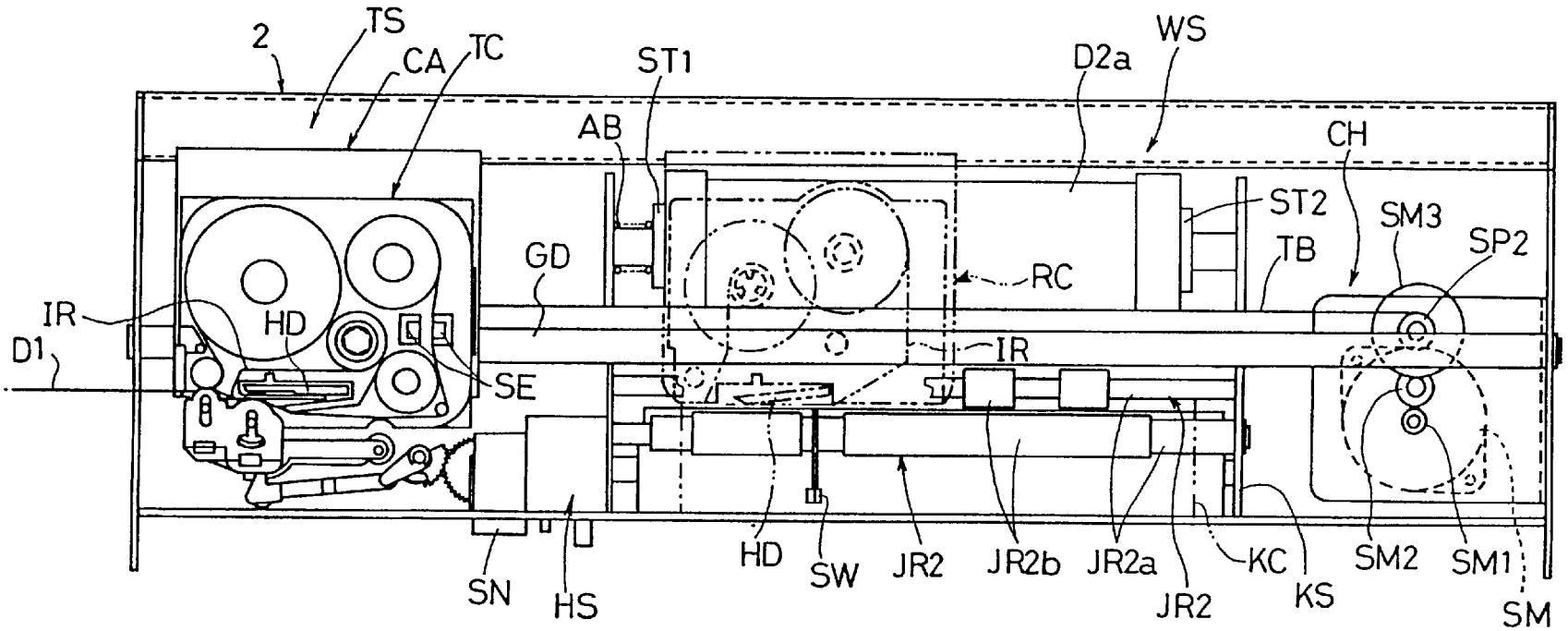
FIG. 2 is a front view of a body frame of the thermal recording apparatus in the first embodiment.
Figure 3:
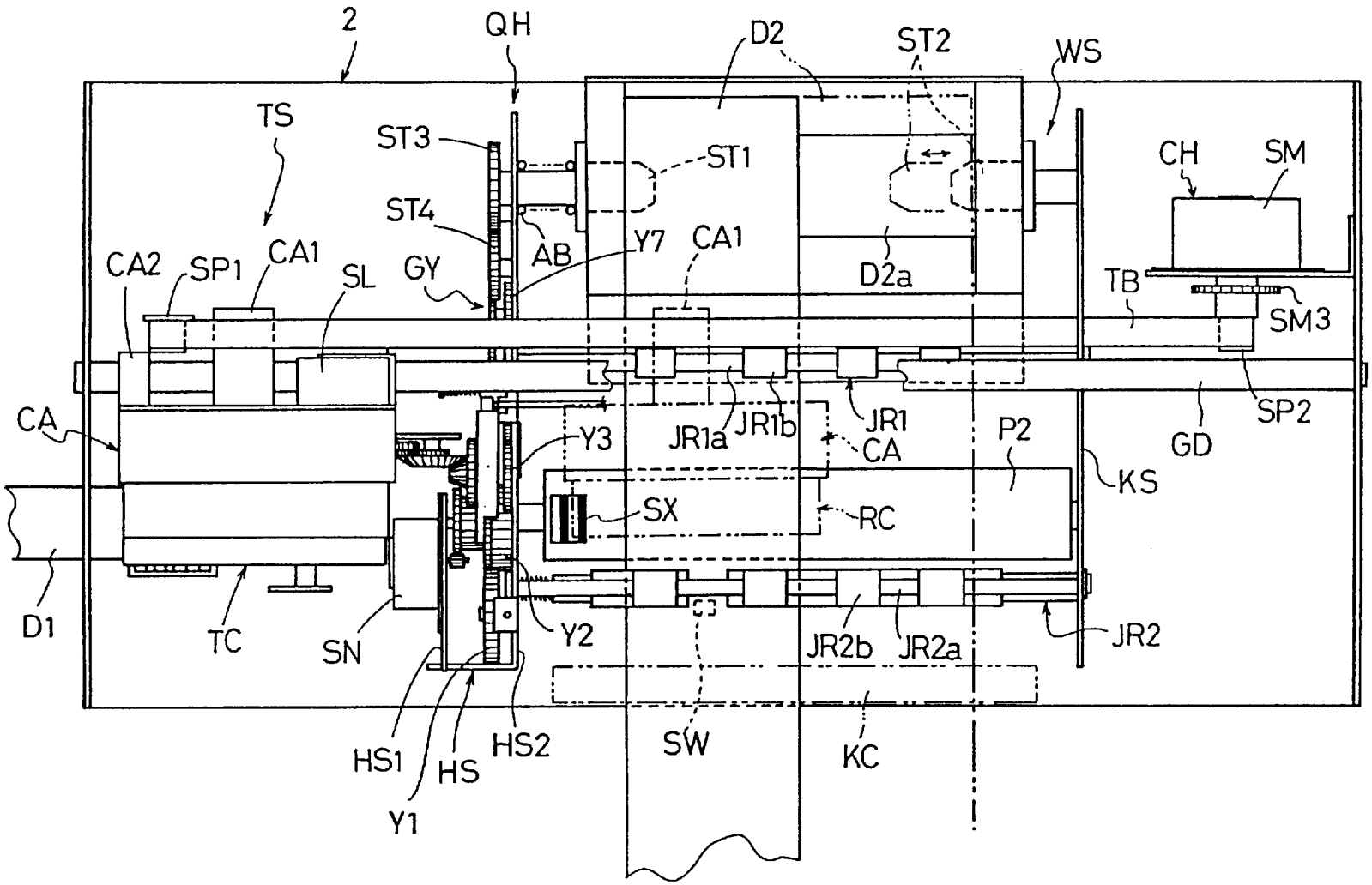
FIG. 3 is a plane view of the body frame of the thermal recording apparatus in the first embodiment.
Figure 4:
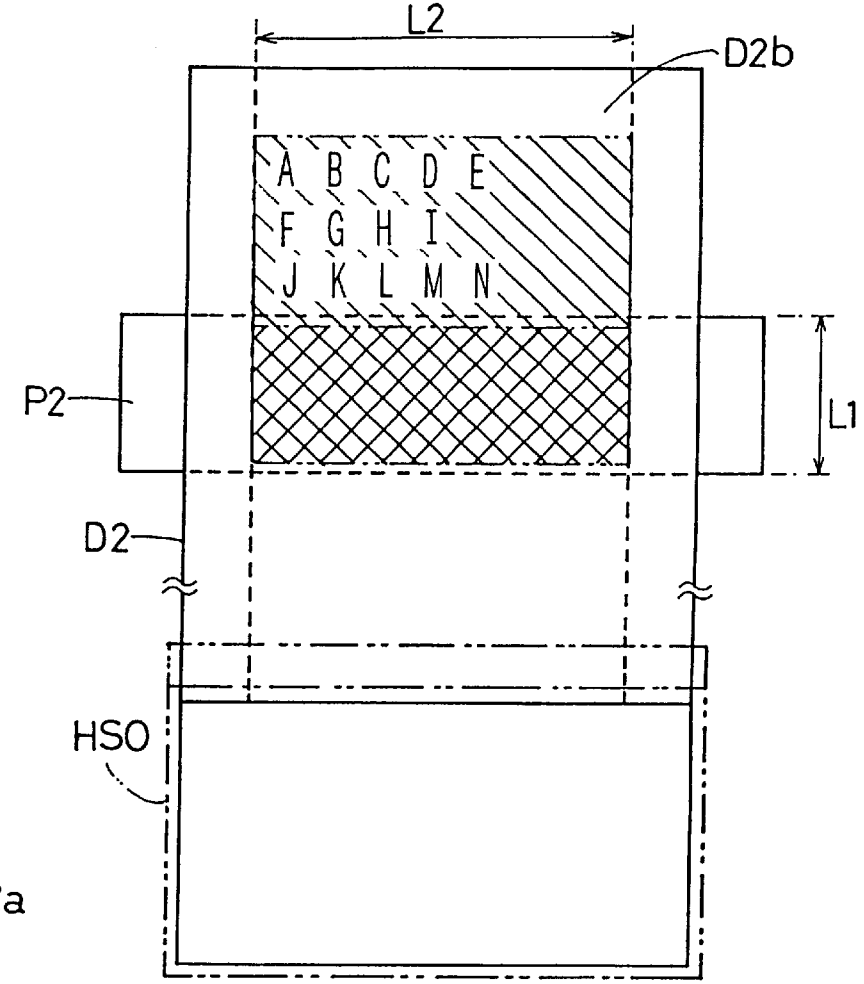
FIG. 4(*a*) is a side view of the thermal recording apparatus in a state of printing a large-width recording medium in the first embodiment.
Figure 4:
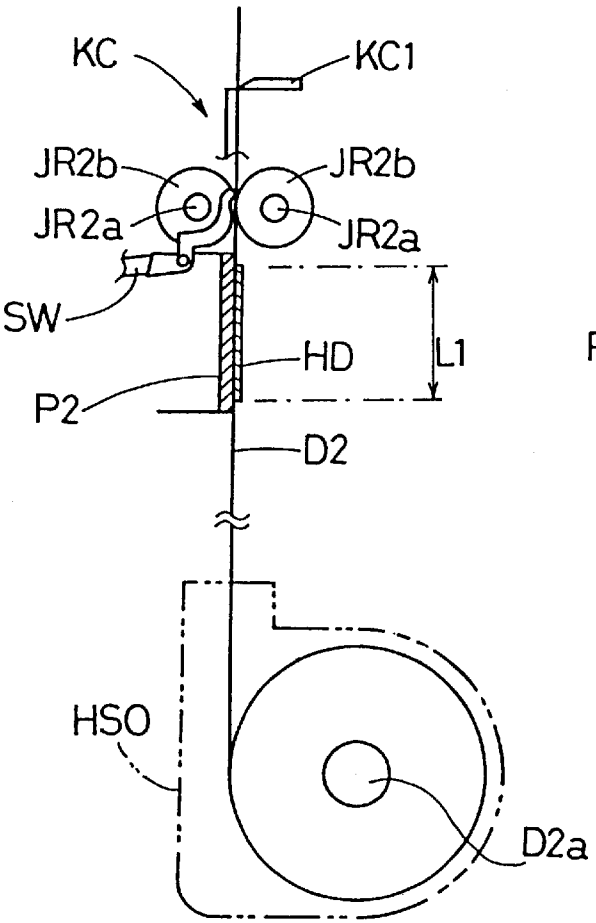
Figure 5:
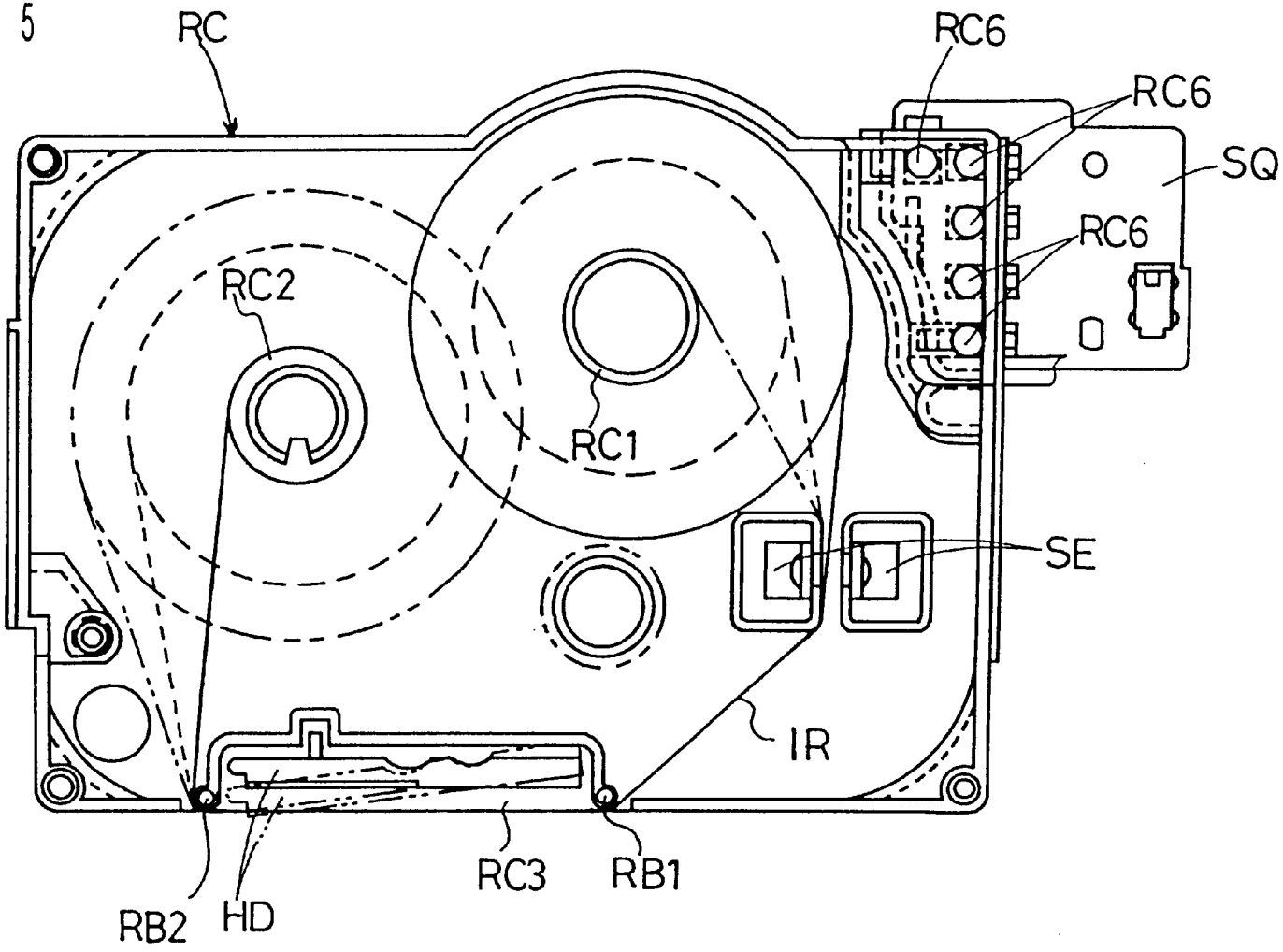
FIG. 5 is a front view of the thermal recording apparatus in which an ribbon cassette is set.
Figure 6:
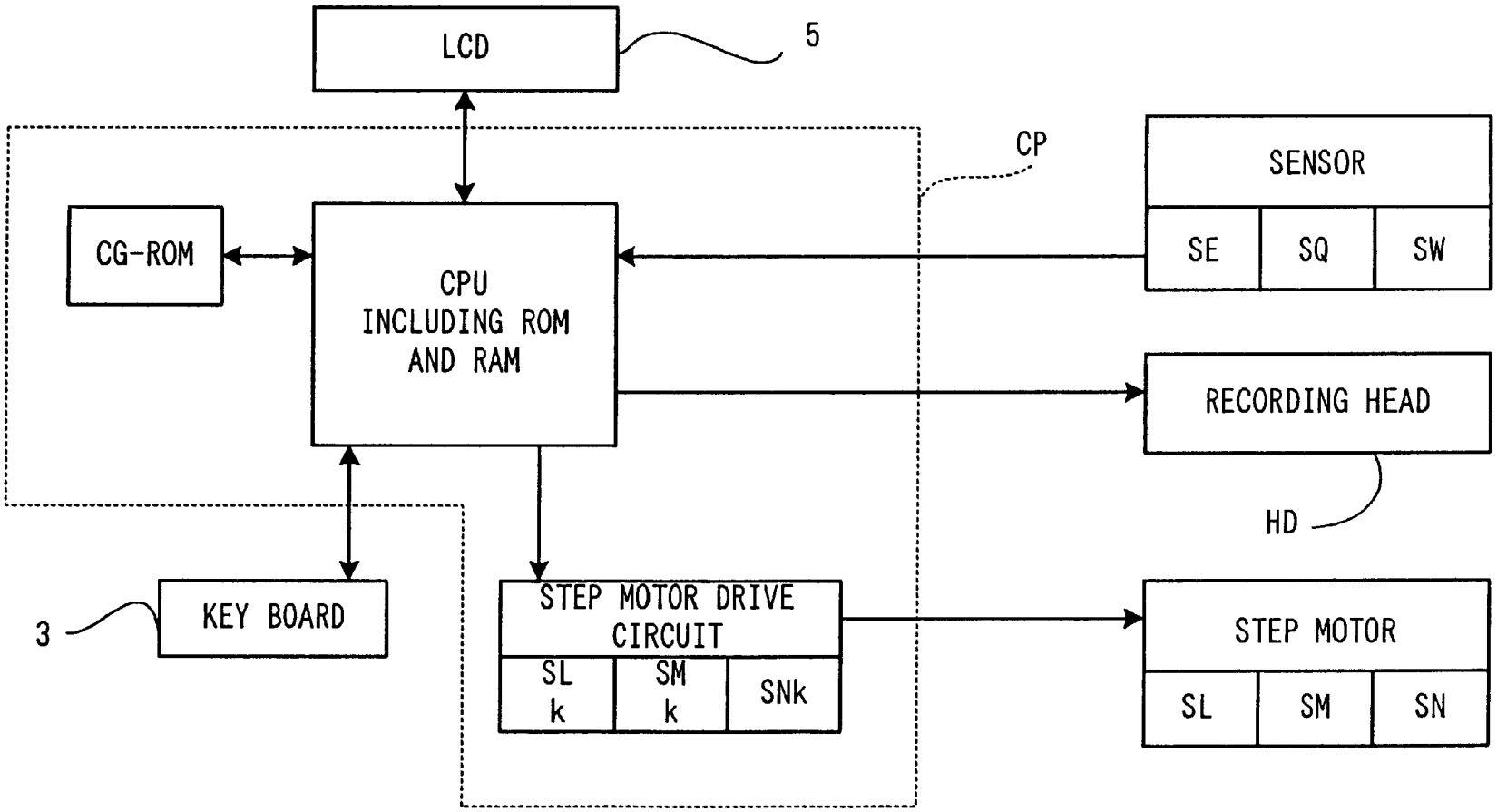
FIG. 6 is a block diagram of a control system of the thermal recording apparatus in the first embodiment.

At first, the structure of the thermal recording apparatus in the first embodiment will be explained with reference to FIGS. 1 to 6. FIG. 1 is a perspective view of a thermal recording apparatus. FIG. 2 is a front view of a body frame of the thermal recording apparatus. FIG. 3 is a plane view of the body frame of the thermal recording apparatus. FIG. 4(*a*) is a side view of the thermal recording apparatus in a state of printing a large-width recording medium and FIG. 4(*b*) is a plane view thereof. FIG. 5 is a front view of the thermal recording apparatus in which an ribbon cassette is set. FIG. 6 is a block diagram of a control system of the thermal recording apparatus.

As shown in FIG. 1, a thermal recording apparatus 1 in the, first embodiment can print various images such as characters such as alphabets, symbols, etc., and marks on a recording medium (tape or image reception normal/special paper) having a small or large width. In this thermal recording apparatus 1, a tape station TS for recording images of a single color on a small-width recording medium D1 as a first recording medium and a wide station WS for recording images of any of multiple or single color(s) on a large-width recording medium D2 as a second recording medium. The thermal recording apparatus 1 discharges the first recording medium D1 printed in a single color in the tape station TS from a discharge port (not shown) formed in a side wall (in a left side in FIG. 1) of a main body frame 2, alternatively, the second recording medium D2 printed in multiple or single color(s) in the wide station WS from another discharge port 2*a* formed in the substantially center of a front face of the main body frame 2.

A keyboard 3 is provided thereon with a return key, a plurality of character keys for inputting alphabets and other characters, mark keys, and further various keys, for example, edition keys such as a cancel key, selection keys for selecting a vertical/lateral printing. The keyboard 3 is connected to the thermal recording apparatus 1 through a cable 4, whereby signals representing data input with the various keys on the keyboard 3 can be transmitted to the thermal recording apparatus 1. The main body frame 2 is provided, on the right side of a front surface thereof (in a right side in FIG. 1), with a display 5 for displaying plural lines of the images such as characters, marks and others input with the keyboard 3.

A cover 7 is also provided on the front surface of the main body frame 2. This cover 7 can be opened toward a user. Accordingly, the user opens the cover 7 and inserts, on a carriage CA, one of a tape cassette TC to be used for a recording operation in the tape station TS and a ribbon cassette RC of multiple or single color(s) to be used for a recording operation in the wide station WS according to the selection of a recording medium by the user, i.e., the first recording medium D1 or the second medium D2. Note that the thermal recording apparatus 1 in the first embodiment can print dot images in a single color on the first recording medium D1 in the tape station TS. The invention, however, is not limited to this embodiment and may be modified so that dot images are printed in full colors.

The printing mechanism to print dot images on the second recording medium D2 in the wide station WS will be explained with reference to FIGS. 2 to 4. As shown in FIGS.

2 and 3, the tape station TS is a recording area disposed on a left side of a base chassis HS of the main frame 2. The wide station WS is another recording area disposed on a right side of the base chassis HS.

In the wide station WS, a recording operation is conducted on the second recording medium in a serial recording mode by moving a recording head HD in a right-to-left direction in FIG. 3, namely, in a sub-scanning direction, which intersects a feeding direction of the second recording medium D2, namely, a direction from an upper side to lower in FIG. 3, or a main-scanning direction. After recording, the second recording medium D2 is fed by a predetermined amount in the feeding direction (the main-scanning direction), and the recording head HD records again while being moved in the sub-scanning direction.

More specifically, while a carriage moving mechanism CH moves a carriage CA mounting thereon the recording head HD reciprocatingly in the sub-scanning direction intersecting the feeding direction of the second recording medium D2, the recording head HD records images such as the characters "ABCDE" in a line in the sub-scanning direction and "FGHI" in another line at the same time, as shown in FIG. 4(*b*), on the second recording medium D2. Upon completion of the recording processing, a feeding mechanism QH feeds the second recording medium D2 by a predetermined amount in correspondence with an arrangement width L1 of a plurality of heating-elements (see FIG. 4(*a*)) in the feeding direction, i.e., in a direction from an upper side to a lower in FIG. 3. The carriage moving mechanism CH moves again the carriage CA in the sub-scanning direction with respect to the second recording medium D2, and the recording head records the characters "JKLMN" in a third line on the second recording medium D2, then repeating the same processing as above.

As shown in FIGS. 2 and 3, this carriage moving mechanism CH is provided with a step motor SM disposed on a right side in the main frame 2, a small diameter gear SM2 which is attached to and meshes with a driving shaft SM1 of the motor SM, a large diameter gear SM3 meshing with the gear SM2, a driving pulley SP2 which rotates integrally with the gear SM3 for rotating a timing belt, a follower pulley SP1 disposed in a left side in the main frame 2, which feeds the timing belt in cooperation with the driving pulley SP2, the timing belt TB laid over the pulleys SP1 and SP2 and secured to a rear end portion CA1 of the carriage CA, and a guide rod GD extending between both side walls of the main frame 2, penetrating a rear end portion CA2 of the carriage CA for supporting the carriage CA.

When the step motor SM is driven to rotate in a regular or reverse direction, the driving pulley SP2 is rotated in one direction or reverse through the driving shaft SM1 and the driving gears SM2 and SM3, moving the timing belt TB in one direction or reverse.

According to the movement of the timing belt TB, the carriage CA on which the recording head HD is mounted is moved by step-feeding between the pulleys SP1 and SP2 along the guide rod GD in a lateral direction in FIGS. 2 and 3, without the use of a head rotation mechanism used in a conventional recording apparatus. The carriage CA can be reciprocated within the recording area of the wide station WS as shown by a two-dot chain line in FIGS. 2 and 3. Note that the number of pulses for controlling the step motor SM exactly corresponds to a feeding amount of the timing belt TB.

If the predetermined number of pulses is supplied to the step motor SM, then the timing belt TB is fed by a predetermined amount, thereby precisely moving the carriage CA.

The feeding mechanism QH for the second recording medium D2 is provided with support members ST1 and ST2 for supporting the second recording medium D2 in a rolled state, disposed in the back side of the main frame 2, paper feeding roller members JR1 and JR2 disposed in that order, parallel to the sub-scanning direction and separately from each other by a predetermined distance in the feeding direction of the second recording medium D2. More specifically, the supporting members ST1 and ST2 are disposed between a long side chassis HSl and a chassis KS and secured thereto respectively. These supporting members ST1 and ST2 are inserted from both sides of the rolled second recording medium D2 into an axial hollow portion D2*a* thereof to support the second recording medium D2. It is noted that a cassette case HSO shown by a two-dot chain line in FIGS. 4(*a*) and 4(*b*) is preferably used to accommodate therein the rolled second recording medium D2, but it is not limited thereto.

In the above case, a compression spring AB is attached to the supporting member ST1 fixed to the base chassis HS thereby to bias the supporting member ST1 toward the chassis KS. The supporting member ST2 fixed to the chassis KS is movable toward the supporting member ST1 in correspondence with a width of the second recording medium D2. Accordingly, both the supporting members ST1 and ST2 can surely support the second recording medium D2 as rolled according to different widths of the second recording medium D2, for example, shown by a solid line or a two-dot chain line in FIG. 3. The top end of the second recording medium D2 can thus be fed toward the roller members JR1 and JR2.

These roller members JR1 and JR2 are each disposed rotatably between a long side chassis HS2 of the base chassis HS and the chassis KS secured in the wide station WS side. A step motor SN is mounted on the short side chassis HS1 of the base chassis HS in the tape station TS side. Driving power of the motor SN being regularly or reversely rotated is transmitted through a gear train GY disposed parallel to the long side chassis HS2 to the roller members JR1 and JR2 and the supporting member ST1, thereby rotating them clockwise or counterclockwise. The gear train GY includes gears Y1–Y7, ST3, and ST4 and others.

The roller member JR1 is constructed of a pair of roller shafts JR1*a* and a plurality of separate rollers JR1*b* mounted on each of the upper and lower roller shafts JR1*a*. The roller member JR2 has the substantially same structure as the JR1. With those roller members JR1 and JR2, the top end of the second recording medium D2 is caught between the rollers JR1*b* of the roller members JR1 and then between the rollers JR2*b* of the roller members JR2, so that the second recording medium D2 is fed forward in accordance with the rotation of the roller members JR1 and JR2 or backward to be rewound.

A second platen P2 is provided on the base of the main frame 2, below the carriage CA moving parallel to the roller members JR1 and JR2, yet therebetween. This second platen P2 is designed to have a substantially flat surface on which the second recording medium D2 is to be supported.

On an upper left surface (a left side in FIG. 3) of the platen P2, a sensor mark SX is formed to be used for detecting a home position of the recording head HD in the wide station WS in the reciprocating movement of the recording head HD along the guide rod GD. When a control unit CP transmits the predetermined number of pulses to the step motor SM to move the recording head HD reciprocatingly in the sub-scanning direction during the recording operation, the home position based on the mark SX of the second platen P2 serves as a standard point for controlling the position of the recording head HD.

Concretely, the mark SX is formed of two patterns each having a reflection part and a non-reflection part alternately arranged, and attached on the second platen P2. A reflecting sensor (not shown) mounted on the carriage CA detects the mark SX as a target.

The control unit CP determines the position where the reflecting sensor detects twice a change point from the reflection part to the non-reflection part as the home position of the carriage CA.

Near the roller members JR2 in a downstream thereof, provided is a detection sensor SW for detecting the top end of the second recording medium D2. The control to feed the second recording medium D2 is executed in accordance with output signals from the sensor SW. For example, when the user sets the second recording medium D2 in a predetermined part of the main frame 2 and feeds the top end of the medium D2 toward the paper feeding roller members JR1 and JR2, the second recording medium D2 can be fed further forth. When the step motor SN is driven to regularly rotate, this regular rotation of the step motor SN is transmitted through the gear train GY to the both roller members JR1 and JR2 and the supporting member ST1 respectively, thus rotating them. The control unit CP continuously drives the step motor SN until the sensor SW detects the top end of the second recording medium D2.

It is noted that the number of pulses for controlling the step motor SN exactly corresponds to the feeding amount of the recording medium D2, unless feeding errors such as a zigzag feeding. The control unit CP controls, accordingly, the recording medium D2 to be fed by transmitting the predetermined number of pulses to the step motor SN.

A cutter unit KC for cutting the second recording medium D2 is disposed downstream of the roller member JR2. This cutter unit KC is operated timely to cut the recording medium D2 under feeding control. Any type of cutter unit KC, as long as it can cut the recording medium D2, may be used. For example, one is a cutter unit which cuts the second recording medium D2 with a blade KC1 (see FIG. 4(*a*)) reciprocating in the width direction of the recording medium D2 (in a lateral direction of FIG. 3), the other is a cutter unit which cuts the same with a different blade KC1 having a length substantially corresponding to the width of the recording medium D2, movable up and down.

Next, a structure of the carriage CA will be explained. The carriage CA can mount, on its mounting surface, selectively any one of the tape cassette TC accommodating the first recording medium D1 and the ink ribbon IR and others (see FIGS. 2 and 3) and the ribbon cassette RC accommodating only the ink ribbon IR (see FIG. 8). On the back side of the carriage CA, a step motor SL (see FIG. 3) is mounted. This step motor SL is used for feeding the ink ribbon IR and the like accommodated in the tape cassette TC mounted on the carriage CA and for making the recording head HD press the second recording medium D2 or release from the same during a recording processing in the wide station WS. The step motor SL is used as a driving power source for the above two purposes in order to effectively utilize the driving power of the step motor SL.

The recording head HD is mounted on the lower side of the carriage CA and, on its recording surface, is provided with a plurality of heating-elements arranged in a row with a predetermined length (corresponding to a print width L1 shown in FIGS. 4(*a*) and 4(*b*)), the heating-elements being able to generate heat per dot. The tape feeding mechanism using the driving power of the step motor SL feeds the ink ribbon IR accommodated in the ribbon cassette RC mounted on the carriage CA toward the recording surface of the recording head HD in a direction orthogonal to the arrangement row of the heating-elements. The heating-elements generating heat melt ink of the ink ribbon IR to make the ink adhere per dot to a recording surface D2*b* of the second recording medium D2.

The ribbon cassette RC is a substantially rectangular cassette case that accommodates an ink ribbon IR with a small width used in the recording in the wide station.

The ribbon cassette RC used for recording character images on the surface D2*b* (see FIG. 4(*b*)) of the second recording medium D2 during a recording process in the wide station WS is provided with a reel RC1 for winding thereon the unused part of an ink ribbon and a reel RC2 for winding thereon the used part of the ink ribbon.

With the rotation of the reel RC2, the ink ribbon IR drawn from the reel RC1 is passed between the sensors SE, and is fed to an open portion RC3 of the ribbon cassette RC via a guide member RB1 (see FIG. 5), finally is wound on the reel RC2 via a guide member RB2.

The color ink ribbon IR in the ribbon cassette RC is applied thereon with a plurality of inks, for example, Cyan (C), Magenta (M), Yellow (Y), etc. by a predetermined length L2 each, namely by a recording area of a line (see FIG. 4(*b*)), which are repeatedly arranged in that order. This is to make the recording head HD moving in the sub-scanning direction record images on the second recording medium D2 in a single color by the length L2 of a line through the part of any one color among magenta, cyan, and yellow of the ink ribbon IR in the length of a line L2, and besides, with a mixed color by one line L2 through several color parts of the ink ribbon IR. Note that the area provided with cross lines shown in FIG. 4(*b*) represents the part recorded by the length L2 of one line by the recording head HD. In this case, dot images of a mixed color of cyan (C), magenta (M), and yellow (Y), e.g., red, blue, etc. are recorded when the heating-elements associated with odd dots are energized to transfer an ink of any one color out of magenta, cyan, and yellow and then the heating-elements corresponding to even dots are energized to transfer an ink of a different color and, if needed, the heating-elements associated with odd or even dots are energized to transfer an ink of a further different color. Note that the ribbon cassette RC to be used for a single color printing does not need having three parts of three inks of cyan, magenta, and yellow.

In order to distinguish the kinds of ink medium set in the ribbon cassette RC, the ribbon cassette RC is provided at its right upper side with a plurality of marks (five marks, for example) RC6.

Those marks RC6 are formed to be concave or not, which indicate a distinction between an ink medium for durable print and that for high-accurate print, yet of a single or multiple color(s).

As shown in FIG. 5, when a sensor SQ detects as to whether the marks RC6 are concave, the control unit CP can detect a distinction between the types of ink medium and the color (a single or multiple color(s)) of the ribbon cassette RC.

The sensor SE is constructed to detect an yellow ink of the ink ribbon IR. When the yellow ink portion of the ink ribbon IR is fed to the sensor SE, the control unit CP can detect that the part is yellow. Accordingly, in a multicolor recording process, the control unit CP detects the start end of the yellow ink portion and feeds precisely the color ink ribbon IR of cyan, magenta, and yellow applied by a predetermined length L2 each, preventing the recording head HD from recording images in incorrect color. On the other hand, in case of a single color ink ribbon, the ink ribbon IR is applied on its entire base material with ink of a single color, e.g., black, and on the terminal end portion with a sensing mark (not shown). When the sensor SE detects the sensing mark, therefore, the control unit CP receives a detection signal from the sensor SE and distinguishes the terminal end portion of the ink ribbon IR.

Next, the control system of the thermal recording apparatus 1 in the embodiment is explained with reference to FIG. 6.

The control unit CP of the thermal recording apparatus 1 includes a central processing unit (CPU) as a core, the CPU including a read only memory (ROM) and a random access memory (RAM). The ROM stores a control program for controlling the driving of the motors SL, SM, and SN, a display program for displaying on the display 5 the images such as characters input with each key on the keyboard 3, dot pattern data on many characters such as alphabets, symbols, etc., the dot pattern data being classified according to fonts (Gothic type, Ming-cho type, etc.) and six print sizes (16, 24, 32, 48, 64, 96 dot sizes) and corresponding to code data, and other programs needed for operating the thermal recording apparatus 1.

The ROM also stores graphic pattern data for graphic images with gradation levels. Note that CG-ROM connected to the CPU is a character generator which produces image data for displaying or printing the character images and the like. The RAM has various data storing area, e.g., a text memory, print buffer, and a counter. The text memory stores data on the text input from the keyboard 3. The print buffer stores data on print dot patterns such as a plurality of characters, symbols, etc. The recording head HD is controlled to execute dot printing in accordance with the dot pattern data stored in the print buffer. The counter stores a count value N to be counted in correspondence to each of the -heating-elements in the gradation control process.

Motor driving circuits SLk, SMk, and SNk are the circuits for driving the step motors SL, SM, and SN respectively. The sensors SQ, SE, and SW detect, as mentioned above, whether the cassette RC is set or not, the type of the ink ribbon IR, the type of the second recording medium D2 and the existence or absence thereof, respectively, and then transmit signals representing the detected result to the CPU. Provided with a plurality of heating-elements arranged in a row, the recording head HD can print images on the second recording medium D2 through the ink ribbon IR by the heating-elements selectively driven by the CPU to generate heat.

Figure 7:
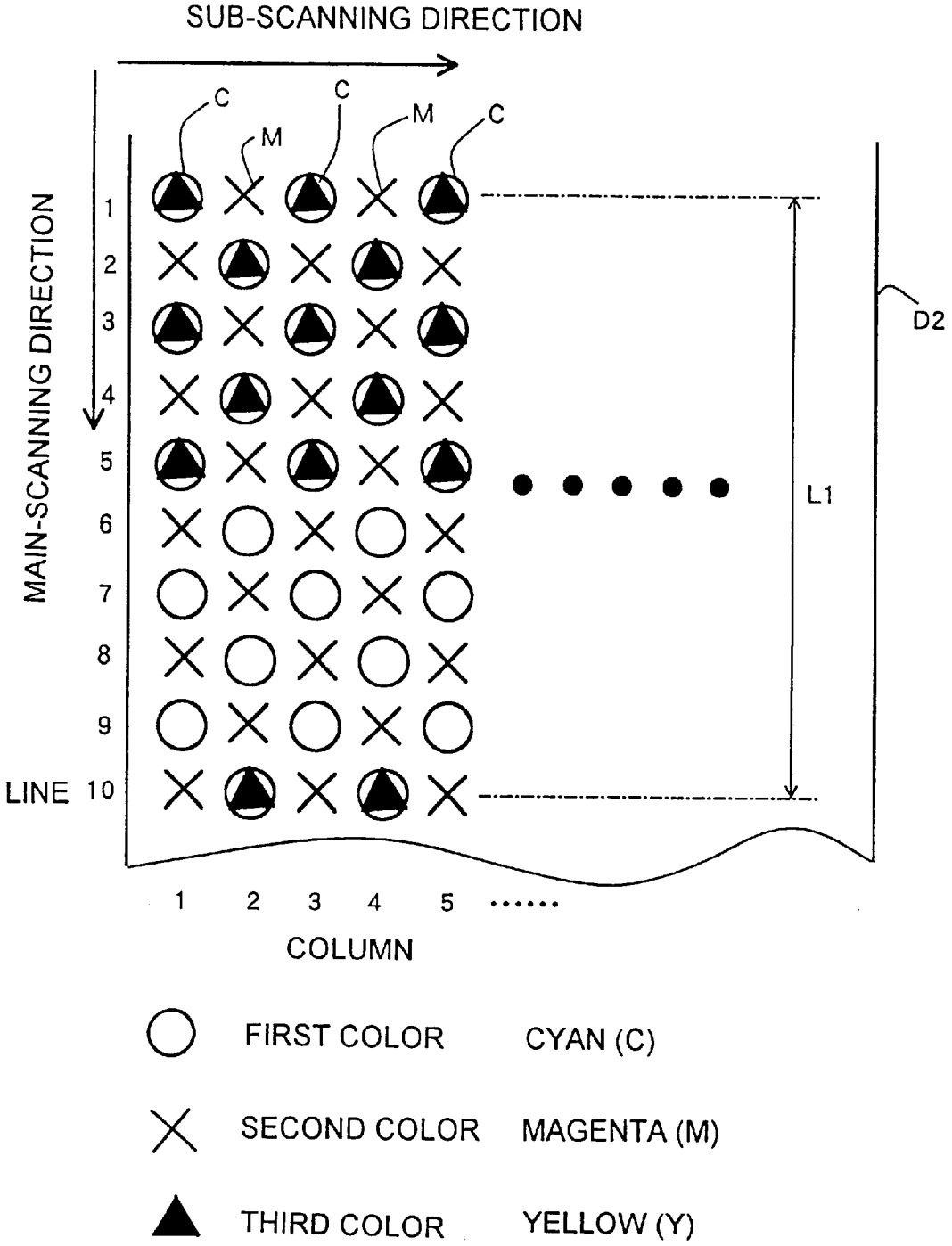
FIG. 7 is a plane view of an example of color-recording on a recordings surface of a recording medium in the first embodiment.

Next, the color-recording of the control unit CP is explained with reference to FIG. 7. FIG. 7 is a plane view of an example of color-recording on a recording surface of a recording medium D2 in the first embodiment.

When character keys on keyboard 3 are operated to form a text including graphic images with gradation levels, the data on the text is stored in a text memory of the RAM. Upon depression of a print key on the keyboard 3, providing a print start command, the print data is produced based on the text data stored in the text memory and the dot pattern data and the graphic pattern data stored in the ROM and then the produced print data is stored in the print buffer. The gradation level control process is started in accordance with the print data to energize each of the selected heating-elements of the recording head HD, starting color dot printing. Note that the color ink ribbon IR is applied with color inks of cyan (C), magenta (M), and yellow (Y) in order.

Explanation will be made below on how the heating-elements of the recording head HD are driven to generate heat, referring to FIG. 7. For convenience of explanation, ten heating-elements are arranged in a row in the feeding direction of the recording medium D2 (referred to as a main-scanning direction hereinafter) and at predetermined intervals within a print width L1. Upon detecting that the ribbon cassette RC is put on the carriage CA through the detection sensor SQ, the CPU drives the heating-elements corresponding to the dots to be printed in cyan (C) based on the data stored in the print buffer to transfer an ink of cyan by a length corresponding to one column (the print width L1) each in the main-scanning direction (up-and-down direction in FIG. 7) through the ink ribbon IR onto the recording surface D2*b* of the recording medium D2, and the CPU operates the carriage moving mechanism CH to move the carriage CA in the sub-scanning direction (rightward in FIG. 7) by a printing pitch. The above driving of the heating-elements by the CPU is repeated every time after the carriage CA is moved in the sub-scanning direction by a printing pitch, thus printing all cyan dots in the length L2 of a line (see FIG. 4). Upon completion of the dot printing of a cyan ink in all columns, the CPU drives the carriage CA to return to a start position (on a left side in FIG. 7) of the transference of inks and, similarly to the above process, magenta(M) dots and yellow(Y) dots are printed in sequence.

The order of the heating-elements driven to generate heat to transfer each ink of cyan, magenta, and yellow is explained hereinafter. At first, the color ink ribbon IR is set so that the part of a cyan ink is disposed in the position corresponding to the heating-elements of the recording head HD. The recording head HD is pressed to the ink ribbon IR, while each of the first, third, fifth, seventh, and ninth heating-elements is applied with a pulse train corresponding to a predetermined gradation level, transferring a cyan ink of the ink ribbon IR to the recording medium D2, as shown by circular marks (○) in FIG. 7. To print dots in the second column, the recording head HD is moved by one column in the sub-scanning direction (rightward in FIG. 7) and the color ink ribbon IR is set so that the part of a cyan ink is disposed in the position corresponding to the heating-elements of the recording head HD. Then, the recording head HD is pressed to the ink ribbon IR, while each of the second, fourth, sixth, eighth, and tenth heating-elements associated with even dots is applied with a pulse train corresponding to a predetermined gradation level, transferring a cyan ink of the ink ribbon IR to the recording medium D2, as shown by circular marks (○) in FIG. 7. Sequentially, to print dots in the third column, the recording head HD is moved by one column in the sub-scanning direction and the color ink ribbon IR is set so that the part of a cyan ink is disposed in the position corresponding to the heating-elements of the recording head HD. Then, the recording head HD is pressed to the ink ribbon IR, while each of the first, third, fifth, seventh, and ninth heating-elements associated with odd dots is applied with a pulse train corresponding to a predetermined gradation level, transferring a cyan ink of the ink ribbon IR to the recording medium D2, as shown by circular marks (○) in FIG. 7. Similarly, the above steps; the setting of a cyan ink part of the ink ribbon IR in the position corresponding to the heating-elements, the movement of the recording head HD by one printing pitch each in the sub-scanning direction, and the alternate driving of the heating-elements associated with odd dots and those associated even dots, are repeated until all of the print data on the dots to be printed in cyan in the length L2 of a line, stored in the print buffer of the RAM, are completely printed.

Subsequently, the recording head HD is moved to the transference start position (the left side in FIG. 7). The color ink ribbon IR is set so that the part of a magenta(M) ink is disposed in the position corresponding to the heating-elements of the recording head HD. The recording head HD is pressed to the ink ribbon IR, while each of the second, fourth, sixth, eighth, and tenth heating-elements associated with even dots is applied with a pulse train corresponding to a predetermined gradation level, transferring a magenta ink of the ink ribbon IR to the recording medium D2, as shown by cross marks (X) in FIG. 7. To print dots in the second column, the recording head HD is moved by one column in the sub-scanning direction (rightward in FIG. 7) and the color ink ribbon IR is set so that the part of a magenta ink is disposed in the position corresponding to the heating-elements of the recording head HD. Then, the recording head HD is pressed to the ink ribbon IR, while each of the first, third, fifth, seventh, and ninth heating-elements associated with odd dots is applied with a pulse train corresponding to a predetermined gradation level, transferring a magenta ink of the ink ribbon IR to the recording medium D2, as shown by cross marks (X) in FIG. 7.

Sequentially, to print dots in the third column, the recording head HD is moved by one column in the sub-scanning direction and the color ink ribbon IR is set. so that the part of a magenta ink is disposed in the position corresponding to the heating-elements of the recording head HD. Then, the recording head HD is pressed to the ink ribbon IR, while each of the second, fourth, sixth, eighth, and tenth heating-elements associated with even dots is applied with a pulse train corresponding to a predetermined gradation level, transferring a magenta ink of the ink ribbon IR to the recording medium D2, as shown by cross marks (X) in FIG. 7. Similarly, the above steps; the setting of a magenta ink part of the ink ribbon IR in the position corresponding to the heating-elements, the movement of the recording head HD by one printing pitch each in the sub-scanning direction, and the alternate driving of the heating-elements associated with odd dots and those associated even dots, are repeated until all of the print data on the dots to be printed in magenta in the length L2 of a line, stored in the print buffer of the RAM, are completely printed.

Sequentially, the recording head HD is return to the transference start position (the left side in FIG. 7). The color ink ribbon IR is set so that the part of an yellow (Y) ink is disposed in the position corresponding to the heating-elements of the recording head HD. The recording head HD is pressed to the ink ribbon IR, while each of the first, third, and fifth heating-elements associated with odd dots is applied with a pulse train corresponding to a predetermined gradation level, transferring an yellow ink of the ink ribbon IR to the recording medium D2, thus forming the first column of color dots, as shown by triangle marks (▲) in FIG. 7. To print dots in the second column, the recording head HD is moved by one column in the sub-scanning direction (rightward in FIG. 7) and the color ink ribbon IR is set so that the part of an yellow ink is disposed in the position corresponding to the heating-elements of the recording head HD. Then, the recording head HD is pressed to the ink ribbon IR, while each of the second, fourth, and tenth heating-elements associated with even dots is applied with a pulse train corresponding to a predetermined gradation level, transferring an yellow ink of the ink ribbon IR to the recording medium D2, thus forming the second column of color dots as shown by triangle marks (▲) in FIG. 7. Sequentially, to print dots in the third column, the recording head HD is moved by one column in the sub-scanning direction and the color ink ribbon IR is set so that the part of an yellow ink is disposed in the position corresponding to the heating-elements of the recording head HD.

Then, the recording head HD is pressed to the ink ribbon IR, while each of the first, third, and fifth heating-elements associated with odd dots is applied with a pulse train corresponding to a predetermined gradation level, transferring an yellow ink of the ink ribbon IR to the recording medium D2, thus forming the third column of color dots, as shown by triangle marks (▲) in FIG. 7.

Similarly, the above steps; the setting of an yellow ink part of the ink ribbon IR in the position corresponding to the heating-element, the movement of the recording head HD by one printing pitch each in the sub-scanning direction, and the alternate driving of the heating-elements associated with odd dots and those associated even dots, are repeated until all of the print data on the dots to be printed in yellow in the length L2 of a line, stored in the print buffer of the RAM, are completely printed.

Subsequently, whenever the recording medium D2 is fed by one print width Li each in the main-scanning direction, as mentioned above, the parts of a cyan, magenta, and yellow inks are disposed in order in the position corresponding to the heating-elements, the heating-elements associated with odd dots and those associated with even dots are alternately driven to generate heat.

In this way, all of the print data stored in the print buffer of the RAM are completely printed.

It is to be noted that the heating-elements associated with odd dots are first driven, but those associated with even dots may be driven first to transfer the inks in the above order.

Figure 8:
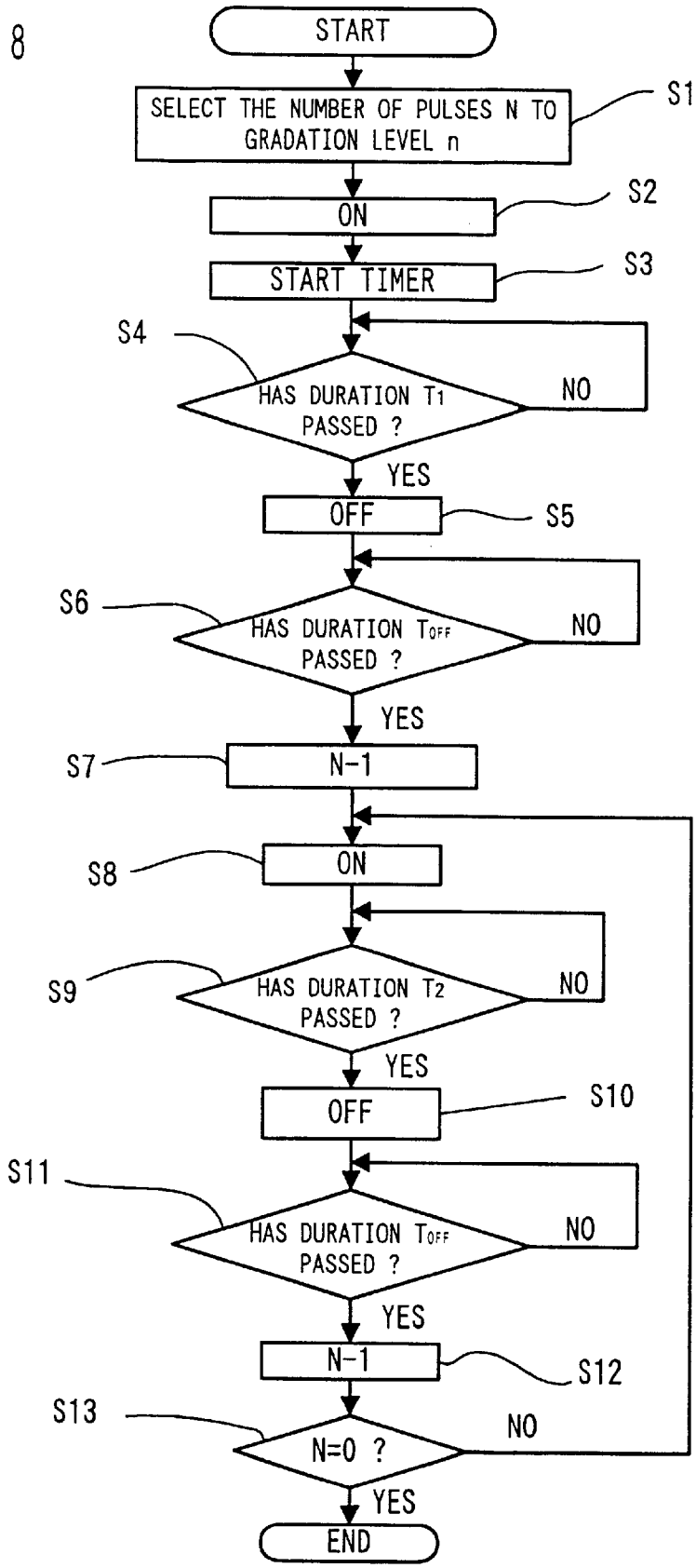
FIG. 8 is a flow chart representing a gradation level control of dot printing to be executed by a control unit of the thermal recording apparatus in the first embodiment.
Figure 10:
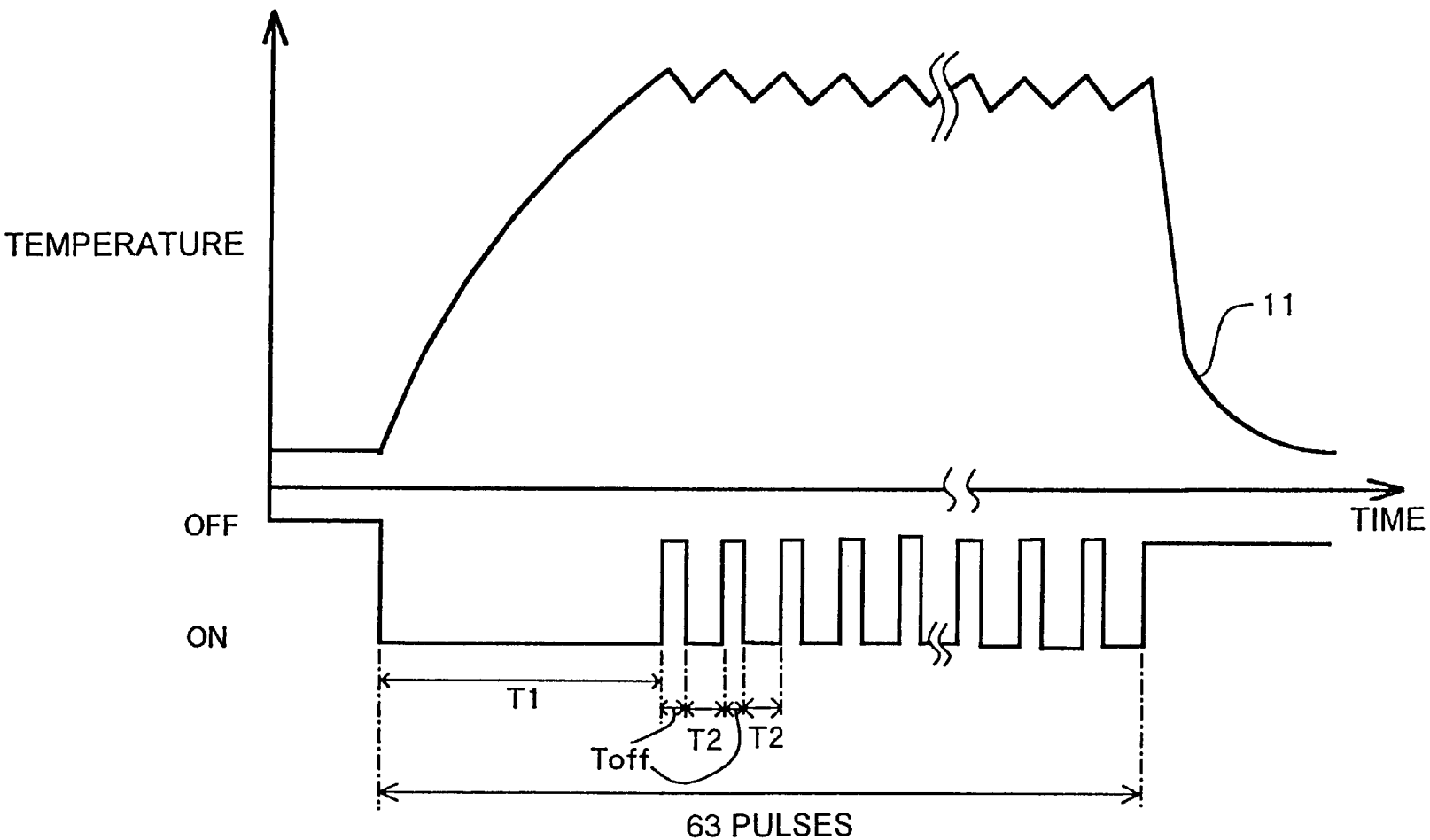
FIG. 10 is a time chart in the case of 63 pulses being applied to a heating-element for a dot print process in the first embodiment.

Next, the gradation level control process executed at the time of each dot printing will be described with reference to FIGS. 8 to 10. FIG. 8 is a flowchart of the gradation level control process executed in the control unit C in the first embodiment. FIG. 9 is a data table listing the number of pulses in a pulse train for the gradation level of the print dot in the embodiment. FIG. 10 is a time chart of the gradation level control process in which 63 pulses are applied to the heating-element.

As shown in FIG. 8, in the gradation level control process, the number of pulses corresponding to the gradation level of a dot to be printed by each heating-element is read from the table 10 (see FIG. 9) stored in the ROM. The number of pulses N with respect to each heating-element is stored in the counter of the RAM (S1).

Here, the table 10 is explained with reference to FIG. 9. The gradation levels in the present embodiment are divided into 8 levels. The number of pulses N corresponding to each gradation level is determined at 2 pulses for the gradation level 1, 4 pulses for the gradation level 2, 6 pulses for the gradation level 3, 8 pulses for the gradation level 4, 12 pulses for the gradation level 5, 20 pulses for the gradation level 6, 32 pulses for the gradation level 7, and 63 pulses for the gradation level 8.

In the table 10, accordingly, the increasing rate of pulses is set so as to be small in the low gradation level and large in the high gradation level.

Subsequently, when the CPU starts the application of pulses to each of the selected heating-elements of the recording head HD to cause the heating-elements to generate heat (S2).

The CPU operates a built-in timer to start (S3), and reads the ON-duration $T_1$ (see FIG. 10) of the first pulse from the ROM and waits until the count time of the timer reaches the ON-duration $T_1$ (S4: NO). When the ON-duration $T_1$ has passed (S4: YES), the CPU interrupts the application of pulses to the selected heating-elements, and stops the timer to reset the count time to 0 and starts the timer again (S5).

Next, the CPU reads the OFF-duration $T_{off}$ of the pulses from the ROM and waits until the timer counts the OFF-duration Toff (S6: NO). When the OFF-duration Toff has passed (S6: YES), the timer is stopped to reset the count time to 0 and then restarted.

Next, the CPU reads the number of pulses N corresponding to each of the selected heating-elements from the counter, subtracts 1 from the number N, and restores the calculated number per the heating-element in the counter (S7). Sequentially, the CPU makes the application of pulses to each of the selected heating-elements of the recording head HD (S8).

The CPU reads the second ON-duration $T_2$ of the application of the second and subsequent pulses and waits until the count time of the timer reaches $T_2$ (S9: NO). After a lapse of the ON-duration $T_2$ (S9: YES), the application of pulses to each of the selected heating-elements is turned OFF, and the timer is stopped to set the count time to 0 and is restarted (S10).

Here, the ON-duration $T_2$ of the second and following pulses is set shorter than the ON-duration $T_1$ of the first pulse.

Next, the CPU reads the OFF-duration Toff of pulses from the ROM and waits until the timer counts the OFF-duration $T_{off}$ (S11: NO). After a lapse of the OFF-duration $T_{off}$ (S11: YES), the CPU stops the timer to reset the count time to 0 and restart the timer.

The CPU reads the number of pulses N corresponding to each of the selected heating-elements from the counter, subtracts 1 from the number N, and restores the calculated number per heating-element in the counter (Sl2).

The CPU reads the number of pulses N from the counter and, if the number N is not 0 (S13: NO), makes the application of pulses to the selected heating-elements (S8). These S8 and following steps are repeated until the number of pulses N reaches 0.

When the number of pulses N is 0 (S13: YES), the application of pulses to the selected heating-elements is terminated.

Next, an example of a change in temperature of a heating-element in the above gradation level control process will be explained, referring to FIG. 10. FIG. 10 is a graph showing the temperature-rise of the heating-element relative to the time when the number of pulses N to be applied to the heating-element is 63.

The first pulse is applied for the duration $T_1$. The increasing temperature curve 11 of the heating-element substantially comes up to the intended heating temperature. The application of pulses is turned off for the duration $T_{off}$ causing a small decrease in temperature. The temperature increases again upon the application of the second pulse for the duration $T_2$. The interruption of pulse application for the duration $T_{off}$ and the execution of pulse application for the duration $T_2$ are repeated until the number of pulses N stored in the counter becomes 0.

The heating-element is preheated by the first applied pulse to a predetermined temperature and then maintained at an almost constant temperature for the duration defined by ($T_2$×62+$T_{off}$×62) by the second through sixty-third applied pulses, so that the dot of the gradation level 8 is color-printed on the recording surface D2*b* of the recording medium D2. Similarly, the dot of the gradation level 1 is printed by the pulse train of 2 pulses. The dot of the level 2 is printed by the pulse train of 4 pulses. The dot of the level 3 is printed by the pulse train of 6 pulses. The dot of the level 4 is printed by the pulse train of 8 pulses. The dot of the level 5 is printed by the pulse train of 12 pulses. The dot of the level 6 is printed by the pulse train of 20 pulses. And the dot of the level 7 is printed by the pulse train of 32 pulses.

As mentioned above, in the thermal recording apparatus 1 in the first embodiment, the text including graphic images with gradation levels is prepared by the operation of character keys on the keyboard 3 and the data on the text is stored in the text memory of the RAM. Upon depression of the print key on the keyboard 3, providing a print start command, the print data is produced based on the text data stored in the text memory and the dot pattern data and the graphic pattern data both stored in the ROM. The produced print data is stored in the print buffer of the RAM. Based on this print data, the gradation level control process is started, applying the predetermined number of pulses to each of the selected heating-elements, to start color printing. In this control process for driving the heating-elements to generate heat in color-printing, each color ink of cyan(C), magenta (M), and yellow(Y) of the ink ribbon IR is set in order to print dots in the length L2 of a line in the sub-scanning direction, while the heating-elements of the recording head HD associated with odd dots and those associated with even dots are alternately driven to generate heat. Additionally, every time the predetermined color ink part of the ink ribbon IR is set, the heating-elements associated with odd dots and those associated with even dots (arranged in the main-scanning direction) are alternately driven at the start time of ink transference. Thus, the print data stored in the print buffer of the RAM are all printed.

Under the gradation level control process by the control unit CP, the pulse width of the first pulse is set to $T_1$, which is applied to the heating-element to preheat it to a predetermined heating temperature, and then, the pulse application is turned off for the duration $T_{off}$. Sequentially, the second pulse is applied for the duration $T_2$. The execution of pulse application for the duration $T_2$ and the interruption of pulse application for the duration $T_{off}$ are repeated the predetermined number of times, completing color printing with a predetermined gradation density.

Accordingly, the cyan(C) ink and the magenta(M) ink are thermally transferred without overlapping each other on the recording surface D2*b* of the recording medium D2, achieving ink thermal transference with uniform color density. The amount of energy to be supplied to a heating-element needs no individually controlling, so that a simple structure can perform the thermal transference of each of cyan(C) and magenta(M) inks, which enables to reduce the size of the thermal recording apparatus 1 and the manufacturing cost thereof. The cyan and magenta inks are thermally transferred in a staggered and latticed arrangement, which can improve blue-print reproducibility by an additive process.

Since the heating-elements associated with odd dots and those associated with even dots are alternately driven to generate heat, the influence by the accumulation of heat on each of the heating-element can be prevented so that color-dots with a fine diameter be printed.

Since the yellow(Y) ink is thermally transferred on only the portion of the cyan(C) ink transferred, the generation of uneven density of a printed dot can be prevented. The yellow ink can be thermally transferred by a simple control, achieving a small-sized thermal recording apparatus 1 and a reduced manufacturing cost thereof. It is to be noted that even when the yellow ink is thermally transferred on only the magenta ink, similarly, the generation of uneven density can be prevented, and the yellow ink can be thermally transferred by a simple control, accomplishing a small-sized thermal recording apparatus 1 and a reduced manufacturing cost thereof.

Furthermore, the inks less overlapping each other, each of the inks can be sufficiently thermally transferred onto the recording medium even if a small amount of energy is supplied to the heating-element at the time of printing a dot of a low gradation level. This can record a print dot of the predetermined gradation level and provide good color images.

Figure 11:
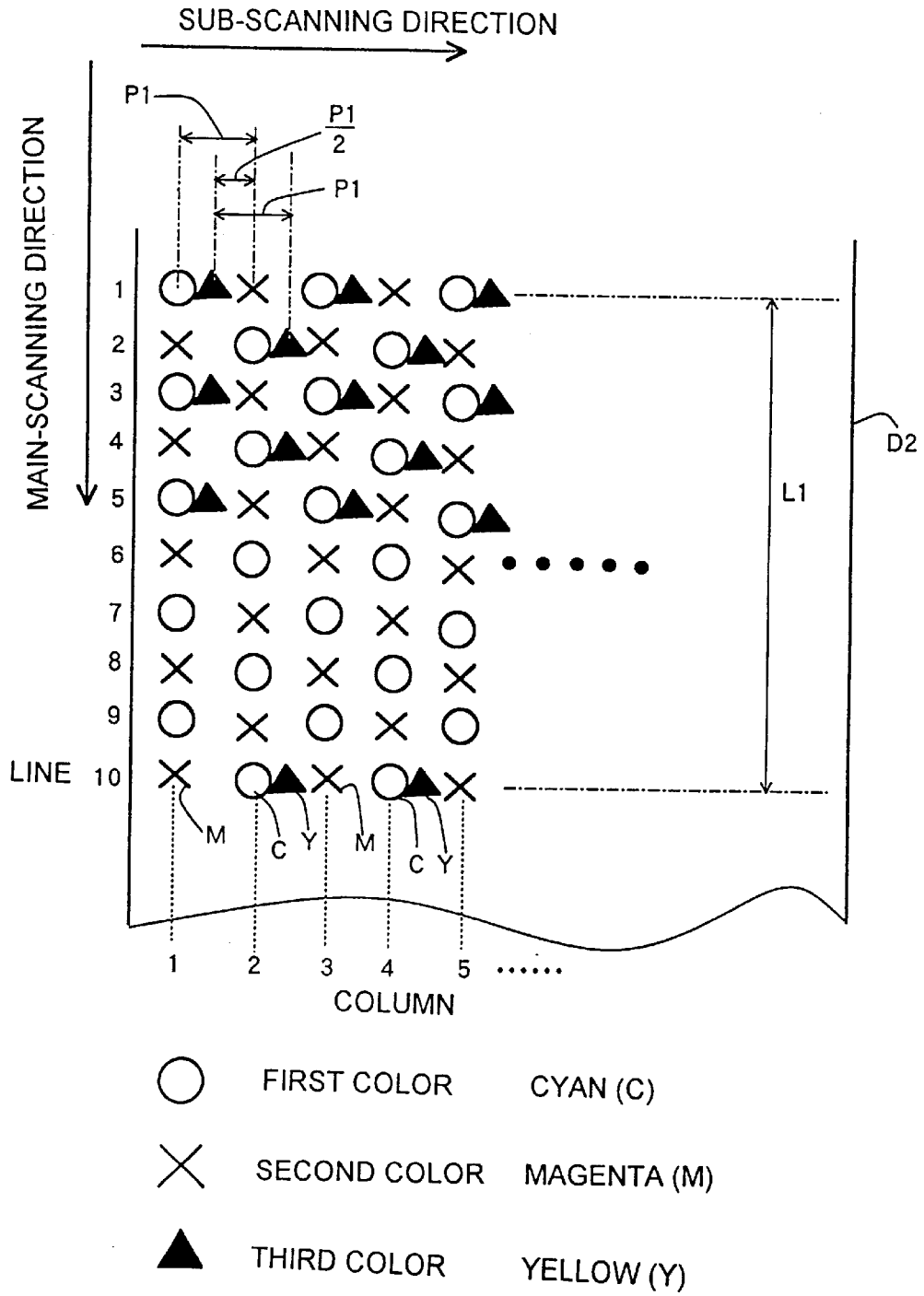
FIG. 11 is a plane view of an example of color-recording on a recording plane of a recording medium in a second embodiment according to the present invention.

Next, a thermal recording apparatus in the second embodiment according to the present invention will be described hereinafter. The structures of the thermal recording apparatus 1 and the control unit CP in the second embodiment are substantially the same as those in the first embodiment. The color dot printing process in the second embodiment is executed by reading the print data stored in the print buffer of the RAM in sequence as well as in the first embodiment, except for the position of an yellow ink transferred on the recording medium as shown in FIG. 11. The gradation level control process executed by the control unit CP in the second embodiment is substantially the same in the first embodiment.

At first, the color-recording of the control unit CP is explained with reference to FIG. 7. FIG. 7 is a plane view of an example of color-recording on a recording plane of a recording medium in the second embodiment.

In FIG. 11, the recording head HD is operated to transfer cyan(C) and magenta(M) inks to form color dots by a line (L2) in the sub-scanning direction (in a right-and-left direction in FIG. 11) as well as in the first embodiment, and then the recording head HD is returned to the start position of the ink transference. The recording head HD is moved by half of a pitch P1 of the above color dot printing of cyan and magenta inks in the sub-scanning direction (rightward in FIG. 11) by the carriage moving mechanism CH, where the printing head HD executes the color dot printing of an yellow ink by a column. After that, the recording head HD, every time after moved by a pitch P1 in the sub-scanning direction by the carriage moving mechanism CH, repeatedly performs an yellow dot printing in a column until the yellow dots are printed in all columns over the length L2 of a line.

The order of the heating-elements driven to generate heat to transfer each ink of cyan, magenta, and yellow is explained hereinafter. At first, the color ink ribbon IR is set so that the part of a cyan ink is disposed in the position corresponding to the heating-elements of the recording head HD. The recording head HD is pressed to the ink ribbon IR, while each of the first, third, fifth, seventh, and ninth heating-elements is applied with a pulse train corresponding to a predetermined gradation level, transferring a cyan ink of the ink ribbon IR to the recording medium D2, as shown by circular marks (○) in FIG. 11. To print dots in the second column, the recording head HD is moved by one column in the sub-scanning direction (rightward in FIG. 11) and the color ink ribbon IR is set so that the part of a cyan ink is disposed in the position corresponding to the heating-elements of the recording head HD. Then, the recording head HD is pressed to the ink ribbon IR, while each of the second, fourth, sixth, eighth, and tenth heating-elements corresponding to even dots is applied with a pulse train corresponding to a predetermined gradation level, transferring a cyan ink of the ink ribbon IR to the recording medium D2, as shown by circular marks (○) in FIG. 11.

Sequentially, to print dots in the third column, the recording head HD is moved by one column in the sub-scanning direction and the color ink ribbon IR is set so that the part of a cyan ink is disposed in the position corresponding to the heating-elements of the recording head HD. Then, the recording head HD is pressed to the ink ribbon IR, while each of the first, third, fifth, seventh, and ninth heating-elements associated with odd dots is applied with a pulse train corresponding to a predetermined gradation level, transferring a cyan ink of the ink ribbon IR to the recording medium D2, as shown by circular marks (○) in FIG. 11. Similarly, the above steps; the setting of a cyan ink part of the ink ribbon IR in the position corresponding to the heating-elements, the movement of the recording head HD by one printing pitch each in the sub-scanning direction, and the alternate driving of the heating-elements associated with odd dots and those associated even dots, are repeated until all of the print data on the dots to be printed in cyan in the length L2 of a line, stored in the print buffer of the RAM, are completely printed.

Subsequently, the recording head HD is moved to the transference start position (the left side in FIG. 11). The color ink ribbon IR is set so that the part of a magenta(M) ink is disposed in the position corresponding to the heating-elements of the recording head HD. The recording head HD is pressed to the ink ribbon IR, while each of the second, fourth, sixth, eighth, and tenth heating-elements associated with even dots is applied with a pulse train corresponding to a predetermined gradation level, transferring a magenta ink of the ink ribbon IR to the recording medium D2, as shown by cross marks (X) in FIG. 11. To print dots in the second column, the recording head HD is moved by one column in the sub-scanning direction (rightward in FIG. 11) and the color ink ribbon IR is set so that the part of a magenta ink is disposed in the position corresponding to the heating-elements of the recording head HD. Then, the recording head HD is pressed to the ink ribbon IR, while each of the first, third, fifth, seventh, and ninth heating-elements associated with odd dots is applied with a pulse train corresponding to a predetermined gradation level, transferring a magenta ink of the ink ribbon IR to the recording medium D2, as shown by cross marks (X) in FIG. 11.

Sequentially, to print dots in the third column, the recording head HD is moved by one column in the sub-scanning direction and the color ink ribbon IR is set so that the part of a magenta ink is disposed in the position corresponding to the heating-elements of the recording head HD. Then, the recording head HD is pressed to the ink ribbon IR, while each of the second, fourth, sixth, eighth, and tenth heating-elements corresponding to even dots is applied with a pulse train corresponding to a predetermined gradation level, transferring a magenta ink of the ink ribbon IR to the recording medium D2, as shown by cross marks (X) in FIG. 11. Similarly, the above steps; the setting of a magenta ink part of the ink ribbon IR in the position corresponding to the heating-elements, the movement of the recording head HD by one printing pitch each in the sub-scanning direction, and the alternate driving of the heating-elements associated with odd dots and those associated even dots, are repeated until all of the print data on the dots to be printed in magenta in the length L2 of a line (see FIG. 4), stored in the print buffer of the RAM, are completely printed.

Sequentially, the recording head HD is return to the transference start position (the left side in FIG. 11) and further moved by half of a pitch P1 of the color dot printing of cyan(C) and magenta(M) inks in the sub-scanning direction by the carriage moving mechanism CH. The color ink ribbon IR is set so that the part of an yellow (Y) ink is disposed in the position corresponding to the heating-elements of the recording head HD. The recording head HD is pressed to the ink ribbon IR, while each of the first, third, and fifth heating-elements associated with odd dots is applied with a pulse train corresponding to a predetermined gradation level, transferring an yellow ink of the ink ribbon IR to the recording medium D2, thus forming the first column of color dots, as shown by triangle marks (▲) in FIG. 11. To print dots in the second column, the recording head HD is moved by a pitch P1 in the sub-scanning direction (rightward in FIG. 11) and the color ink ribbon IR is set so that the part of an yellow ink is disposed in the position corresponding to the heating-elements of the recording head HD. Then, the recording head HD is pressed to the ink ribbon IR, while each of the second, fourth, and tenth heating-elements corresponding to even dots is applied with a pulse train corresponding to a predetermined gradation level, transferring an yellow ink of the ink ribbon IR to the recording medium D2, thus forming the second column of color dots as shown by triangle marks (▲) in FIG. 11. Sequentially, to print dots in the third column, the recording head HD is moved by a pitch P1 in the sub-scanning direction and the color ink ribbon IR is set so that the part of an yellow ink is disposed in the position corresponding to the heating-elements of the recording head HD.

Then, the recording head HD is pressed to the ink ribbon IR, while each of the first, third, and fifth heating-elements associated with odd dots is applied with a pulse train corresponding to a predetermined gradation level, transferring an yellow ink of the ink ribbon IR to the recording medium D2, thus forming the third column of color dots, as shown by triangle marks (▲) in FIG. 11.

Similarly, the above steps; the setting of an yellow ink part of the ink ribbon IR in the position corresponding to the heating-element, the movement of the recording head HD by one printing pitch each in the sub-scanning direction, and the alternate driving of the heating-elements associated with odd dots and those associated even dots, are repeated until all of the print data on the dots to be printed in yellow in the length L2 of a line, stored in the print buffer of the RAM, are completely printed.

Subsequently, whenever the recording medium D2 is fed by one print width Li each in the main-scanning direction, as mentioned above, the parts of a cyan, magenta, and yellow inks are disposed in order in the position corresponding to the heating-elements, the heating-elements associated with odd dots and those associated with even dots are alternately driven to generate heat.

In this way, all of the print data stored in the print buffer of the RAM are completely printed.

It is to be noted that the heating-elements associated with odd dots are first driven, but those associated with even dots may be driven first to transfer the inks in the above order.

As mentioned above, in the thermal recording apparatus 1 in the second embodiment, each of the heating-elements is controlled to generate heat to form color dots of cyan(C) and magenta(M) in a a line L2 in the sub-scanning direction (in a right-and-left direction in FIG. 11). After that, the recording head HD is returned to the start position of the color printing of the cyan and magenta inks and, then, is moved by half of a pitch P1 of the color dot printing of the cyan and magenta inks by the carriage moving mechanism CH. The recording head HD operates to print yellow dots in the first column. Every time after the recording head HD is moved by a pitch P1 in the sub-scanning direction, the recording head HD performs the yellow dot printing in a column each until dots in all columns within the length L2 of a line in the sub-scanning direction are printed.

Accordingly, the cyan(C) ink and magenta(M) ink are thermally transferred without overlapping each other on the recording surface D2*b* of the recording medium D2, achieving ink thermal transference with uniform color density. The amount of energy to be supplied to a heating-element needs no individually controlling, so that a simple structure can thermally transfer each ink of cyan(C) and magenta(M), thereby reducing the size of the thermal recording apparatus 1 and reducing the manufacturing cost thereof. The cyan ink and magenta ink are thermally transferred in a staggered and latticed arrangement, which can improve blue-print reproduction by an additive process.

Since the heating-elements associated with odd dots and those associated with even dots are alternately driven to generate heat, the influence by the accumulation of heat on each of the heating-element can be prevented so that color-dots with a fine diameter be printed.

The yellow(Y) ink is thermally transferred between the cyan(c) ink and the magenta(M) ink in the sub-scanning direction, yet in a staggered and latticed arrangement, which can reduce the overlapping of the yellow dots on other color dots, thereby improving color reproducibility.

Furthermore, the energy to each of the heating-elements needs no individually controlling for transferring an yellow ink, so that the yellow ink can be thermally transferred by a simple control, thus reducing the size of the thermal recording apparatus 1 and the manufacturing cost thereof.

Next, a thermal recording apparatus in the third embodiment according to the present invention will be described hereinafter.

Figure 12:
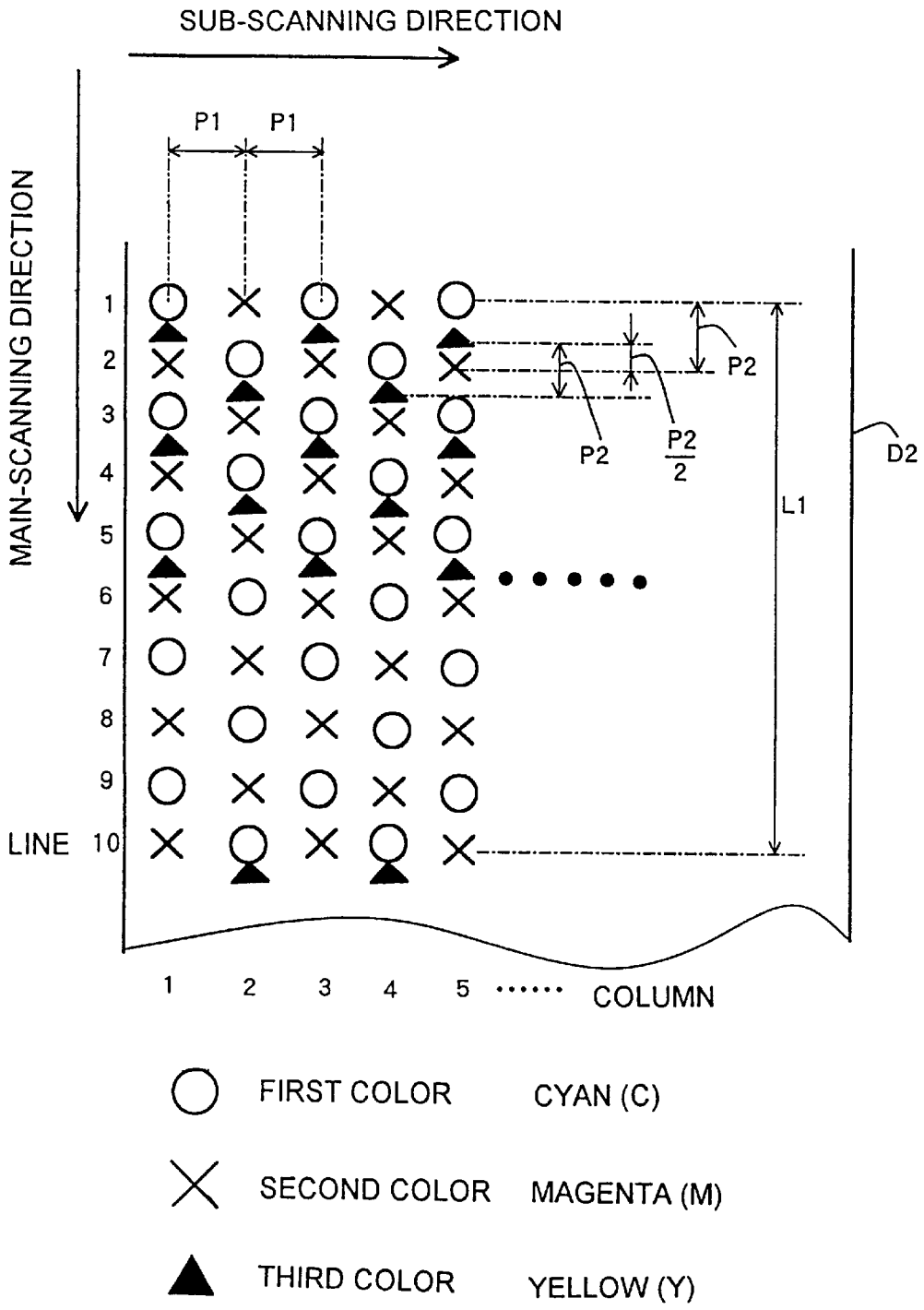
FIG. 12 is a plane view of an example of color-recording on a recording plane of a recording medium in a third embodiment according to the present invention.

The structures of the thermal recording apparatus 1 and the control unit CP in the third embodiment are substantially the same as those in the first embodiment. The color dot printing process in the third embodiment is executed by reading the print data stored in the print buffer of the RAM in sequence as well as in the first embodiment, except for the position of an yellow ink transferred on the recording medium as shown in FIG. 12. The gradation level control process executed by the control unit CP in the third embodiment is substantially the same in the first embodiment.

At first, the color-recording of the control unit CP is explained with reference to FIG. 12. FIG. 12 is a plane view of an example of color-recording on a recording plane of a recording medium in the third embodiment.

In FIG. 12, the recording head HD is operated to transfer a cyan(C) ink and a magenta(M) ink to form color dots in all columns over the length L2 of a line (see FIG. 4) in the sub-scanning direction (in a right-and-left direction in FIG. 12) as well as in the first embodiment, and then the recording medium D2 is fed back (upward in FIG. 12) by half of a pitch P2 in the main-scanning direction by the feeding mechanism QH for the recording medium.

In this state, the printing head HD performs the color dot printing of an yellow ink by a column. After that, the recording head HD, every time after moved by a pitch P1 in the sub-scanning direction by the carriage moving mechanism CH, repeatedly performs an yellow dot printing in a column until the yellow dots are printed in all columns over the length L2 of a line.

The order of the heating-elements driven to generate heat to transfer each ink of cyan, magenta, and yellow is explained hereinafter. At first, the color ink ribbon IR is set so that the part of a cyan ink is disposed in the position corresponding to the heating-elements of the recording head HD. The recording head HD is pressed to the ink ribbon IR, while each of the first, third, fifth, seventh, and ninth heating-elements is applied with a pulse train corresponding to a predetermined gradation level, transferring a cyan ink of the ink ribbon IR to the recording medium D2, as shown by circular marks (○) in FIG. 12. To print dots in the second column, the recording head HD is moved by one column in the sub-scanning direction (rightward in FIG. 12) and the color ink ribbon IR is set so that the part of a cyan ink is disposed in the position corresponding to the heating-elements of the recording head HD. Then, the recording head HD is pressed to the ink ribbon IR, while each of the second, fourth, sixth, eighth, and tenth heating-elements corresponding to even dots is applied with a pulse train corresponding to a predetermined gradation level, transferring a cyan ink of the ink ribbon IR to the recording medium D2, as shown by circular marks (○) in FIG. 12.

Sequentially, to print dots in the third column, the recording head HD is moved by one column in the sub-scanning direction and the color ink ribbon IR is set so that the part of a cyan ink is disposed in the position corresponding to the heating-elements of the recording head HD. Then, the recording head HD is pressed to the ink ribbon IR, while each of the first, third, fifth, seventh, and ninth heating-elements associated with odd dots is applied with a pulse train corresponding to a predetermined gradation level, transferring a cyan ink of the ink ribbon IR to the recording medium D2, as shown by circular marks (○) in FIG. 12. Similarly, the above steps; the setting of a cyan ink part of the ink ribbon IR in the position corresponding to the heating-elements, the movement of the recording head HD by one printing pitch each in the sub-scanning direction, and the alternate driving of the heating-elements associated with odd dots and those associated even dots, are repeated until all of the print data on the dots to be printed in cyan over the length L2 of a line, stored in the print buffer of the RAM, are completely printed.

Subsequently, the recording head HD is moved to the transference start position (the left side in FIG. 12). The color ink ribbon IR is set so that the part of a magenta(M) ink is disposed in the position corresponding to the heating-elements of the recording head HD. The recording head HD is pressed to the ink ribbon IR, while each of the second, fourth, sixth, eighth, and tenth heating-elements associated with even dots is applied with a pulse train corresponding to a predetermined gradation level, transferring a magenta ink of the ink ribbon IR to the recording medium D2, as shown by cross marks (X) in FIG. 12. To print dots in the second column, the recording head HD is moved by one column in the sub-scanning direction (rightward in FIG. 12) and the color ink ribbon IR is set so that the part of a magenta ink is disposed in the position corresponding to the heating-elements of the recording head HD. Then, the recording head HD is pressed to the ink ribbon IR, while each of the first, third, fifth, seventh, and ninth heating-elements corresponding to odd dots is applied with a pulse train corresponding to a predetermined gradation level, transferring a magenta ink of the ink ribbon IR to the recording medium D2, as shown by cross marks (X) in FIG. 12.

Sequentially, to print dots in the third column, the recording head HD is moved by one column in the sub-scanning direction and the color ink ribbon IR is set so that the part of a magenta ink is disposed in the position corresponding to the heating-elements of the recording head HD. Then, the recording head HD is pressed to the ink ribbon IR, while each of the second, fourth, sixth, eighth, and tenth heating-elements corresponding to even dots is applied with a pulse train corresponding to a predetermined gradation level, transferring a magenta ink of the ink ribbon IR to the recording medium D2, as shown by cross marks (X) in FIG. 12. Similarly, the above steps; the setting of a magenta ink part of the ink ribbon IR in the position corresponding to the heating-elements, the movement of the recording head HD by one printing pitch each in the sub-scanning direction, and the alternate driving of the heating-elements associated with odd dots and those associated even dots, are repeated until all of the print data on the dots to be printed in magenta in the length L2 of a line (see FIG. 4), stored in the print buffer of the RAM, are completely printed.

Sequentially, the recording head HD is return to the transference start position (the left side in FIG. 12) and further the recording medium D2 is fed back (upward in FIG. 12) by half of a pitch P2 in the main-scanning direction of the color dot printing of cyan(C) and magenta(M) inks by the feeding mechanism QH. In this state, the color ink ribbon IR is set so that the part of an yellow (Y) ink is disposed in the position corresponding to the heating-elements of the recording head HD. The recording head HD is pressed to the ink ribbon IR, while each of the first, third, and fifth heating-elements associated with odd dots is applied with a pulse train corresponding to a predetermined gradation level, transferring an yellow ink of the ink ribbon IR to the recording medium D2, thus forming the first column of color dots, as shown by triangle marks (▲) in FIG. 12. To print dots in the second column, the recording head HD is moved by a pitch P1 in the sub-scanning direction (rightward in FIG. 12) and the color ink ribbon IR is set so that the part of an yellow ink is disposed in the position corresponding to the heating-elements of the recording head HD. Then, the recording head HD is pressed to the ink ribbon IR, while each of the second, fourth, and tenth heating-elements corresponding to even dots is applied with a pulse train corresponding to a predetermined gradation level, transferring an yellow ink of the ink ribbon IR to the recording medium D2, thus forming the second column of color dots as shown by triangle marks (▲) in FIG. 12. Sequentially, to print dots in the third column, the recording head HD is moved by a pitch P1 in the sub-scanning direction and the color ink ribbon IR is set so that the part of an yellow ink is disposed in the position corresponding to the heating-elements of the recording head HD.

Then, the recording head HD is pressed to the ink ribbon IR, while each of the first, third, and fifth heating-elements corresponding to odd dots is applied with a pulse train corresponding to a predetermined gradation level, transferring an yellow ink of the ink ribbon IR to the recording medium D2, thus forming the third column of color dots, as shown by triangle marks (▲) in FIG. 12. Similarly, the above steps; the setting of an yellow ink part of the ink ribbon IR in the position corresponding to the heating-element, the movement of the recording head HD by one printing pitch each in the sub-scanning direction, and the alternate driving of the heating-elements associated with odd dots and those associated even dots, are repeated until all of the print data on the dots to be printed in yellow in the length L2 of a line (see FIG. 4), stored in the print buffer of the RAM, are completely printed.

Consecutively, the feeding mechanism QH feeds the recording medium D2 by half of a pitch P2 in the main-scanning direction (downward in FIG. 12).

Subsequently, whenever the recording medium D2 is fed by one print width Li each in the main-scanning direction, as mentioned above, the parts of a cyan, magenta, and yellow inks are disposed in order in the position corresponding to the heating-elements, the heating-elements associated with odd dots and those associated with even dots are alternately driven to generate heat.

In this way, all of the print data stored in the print buffer of the RAM are completely printed.

It is to be noted that the heating-elements associated with odd dots are first driven, but those associated with even dots may be driven first to transfer the inks in the above order.

As mentioned above in detail, in the thermal recording apparatus 1 in the third embodiment, each of the heating-elements is controlled to generate heat to form color dots of cyan(C) and magenta(M) in the length L2 of a line in the sub-scanning direction (in a right-and-left direction in FIG. 12). After that, the recording head HD is returned to the start position of the color printing of the cyan and magenta inks and the recording medium D2 is fed back (upward in FIG. 12) by half of a pitch P2 in the main-scanning direction by the feeding mechanism QH. The recording head HD then operates to print yellow dots in the first column. Every time after the recording head HD is moved by a pitch P1 in the sub-scanning direction, the recording head HD performs the yellow dot printing in a column each until dots in all columns are printed in the length L2 of a line in the sub-scanning direction.

Finally, the feeding mechanism QH feeds the recording medium D2 by half of a pitch P2 in the main-scanning direction (downward in FIG. 12). Similarly, whenever the recording medium D2 is fed by the print width L1 in the main-scanning direction after the color dot printing in a corresponding area, the parts of a cyan(C), magenta(M), and yellow(Y) inks of the ink ribbon IR are set in order in the position corresponding to the heating-elements, while the heating-elements associated with odd dots and those associated with even dots are alternately driven to individually transfer the inks until all data stored in the print buffer of the RAM is printed.

Accordingly, the cyan(C) ink and magenta(M) ink are thermally transferred without overlapping each other on the recording surface D2*b* of the recording medium D2, achieving ink thermal transference with uniform color density. The amount of energy to be supplied to a heating-element, needs no individually controlling, so that a simple structure can heat-transfer each ink of cyan(C) and magenta(M), compactizing the thermal recording apparatus 1 and reducing the manufacturing cost thereof. The ink of cyan and that of magenta are heat-transferred in a staggered and latticed arrangement, which can improve blue-print reproducibility by an additive process.

Since the heating-elements associated with odd dots and those associated with even dots are alternately driven to generate heat, the influence by the accumulation of heat on each of the heating-element can be prevented so that color-dots with a fine diameter be printed.

The yellow(Y) ink is thermally transferred between the cyan(C) ink and the magenta(M) ink in the main-scanning direction, yet in a staggered and latticed arrangement, which can reduce the overlapping of the yellow dots on other color dots, thereby improving color reproducibility.

Furthermore, the energy to each of the heating-elements needs no individually controlling for transferring an yellow ink, so that the yellow ink can be thermally transferred by a simple control, thus reducing the size of the thermal recording apparatus 1 and the manufacturing cost thereof.

The present invention may be embodied in other specific forms without departing from the spirit or essential characteristics thereof.

(a) For instance, although the number of pulses according to the gradation level is set in accordance with the table 10 in the above embodiment, each of the number of pulses in the table 10 may be changed in correspondence with the kinds of ink and others.

(b) Although the maximum number of pulses in level 8 is set at 63 pulses in the above embodiment, it may be set at more than 63 if the application duration $T_1$ is lengthened and the ON-duration $T_2$ and the OFF-duration $T_{off}$ are shortened.

(c) Although the recording head HD is provided with ten heating-elements in the above embodiments, more than ten heating-elements may be provided. Also, the heating-elements may be arranged in not only a row but also plural rows.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment chosen and described in order to explain the principles of the invention and its practical application to enable one skilled in the art to utilize the invention in various embodiments and with various modifications as are suited to the particular use contemplated.

It is intended that the scope of the invention be defined by the claims appended hereto, and their equivalents.

What is claimed is:

1. A thermal recording apparatus including:

a thermal head provided with a plurality of heating-elements, the thermal head being movable in a first direction;

a drive device for selectively driving the heating-elements to generate heat;

an ink ribbon applied thereon with at least a first color ink, a second color ink and a third color ink;

a print medium on which images are to be printed through the ink ribbon by the selected heating-elements, the print medium being fed in a second direction intersecting the first direction;

means for dividing the heating-elements into a first group of odd heating-elements and a second group of even heating-elements, and alternately driving the odd heating-elements and the even heating-elements at different time points;

a memory for storing image data corresponding to the first color, image data corresponding to the second color and image data corresponding to the third color;

control means for operating the drive device to drive one group of the first heating-element group and the second heating-element group to generate heat and, after moving the thermal head by one pitch defined by a print dot in the first direction, operating the drive device again to drive another group of the first heating-element group and the second heating-element group to generate heat, thereby to print the first color ink on the print medium based on the image data, and for operating the drive device to drive the another group that is different from the one group driven first to print the first color ink thereby to print the second color ink on positions where the first color ink has not been printed on the print medium; and means for determining a first print position of the third color ink in correspondence with a position determined by the thermal head that is moved by half of one pitch of a print dot in the first direction from positions where the first and second color inks are printed.

2. A thermal recording apparatus according to claim 1, wherein the control means drives the one group to print the third color ink based on the image data on the print medium so that the third color ink overlaps the first color ink printed previously.

3. A thermal recording apparatus according to claim 1, wherein the control means drives the another group to print the third color ink based on the image data on the print medium so that the third color ink overlaps the first color ink printed previously.

4. A thermal recording apparatus according to claim 1, wherein the control means operates the drive device to drive the one group to generate heat in the position determined by the first print position determining means and, after moving the thermal head by one pitch of a print dot in the first direction, operates the drive device again to drive the other group, which was not driven previously, thereby to print the third color ink based on the image data on the print medium.

5. A thermal recording apparatus according to claim 1, further including means for determining a second print position of the third color ink in correspondence with a position determined by the thermal head that is moved by half of one pitch of a print dot in the second direction from positions where the first and second color inks are printed.

6. A thermal recording apparatus according to claim 1, wherein the control means operates the drive device to drive the one group to generate heat in the position determined by the second print position determining means and, after moving the thermal head by one pitch of a print dot in the second direction, operating the drive device again to drive the other group, which was not driven previously, thereby to print the third color ink based on the image data on the print medium.

7. A thermal recording apparatus according to claim 1, wherein the first, second, and third color are cyan, magenta, and yellow, respectively, and the ink ribbon is applied with a cyan ink, a magenta ink, and an yellow ink consecutively.

8. A thermal recording apparatus according to claim 1, further including a memory for storing an amount of energy to be supplied to the heating-element, the energy amount being quantized in multiple levels in accordance with gradation levels of a print dot to be printed by the heating-element, and wherein the control means operates the drive device to drive the heating-element to generate heat in accordance with the energy level stored in the energy amount memory.

9. At thermal recording apparatus according to 1, further including:

pulse application means for selectively applying a drive pulse train to the heating-elements;

pulse number setting means for setting a number of pulses of the drive pulse train according to gradation level of a print dot to be printed by the heating-elements;

pulse width setting means for setting a width of a first drive pulse of the drive pulse train to be larger than those of a second and subsequent drive pulses; and pulse control means for applying the first drive pulse to the heating-elements thereby to preheat the same up to a predetermined heating temperature and then the second and subsequent drive pulses to the preheated heating-elements to record the print dot.

10. A thermal recording apparatus according to claim 9, wherein the pulse number setting means sets the number of the second and subsequent drive pulses of the drive pulse train so as to be larger as the gradation level of the print dot becomes higher, and sets an increasing rate of the number of pulses so as to be low in a low gradation level area and high in a high gradation level area.

11. A thermal recording apparatus according to claim 1, further including:

a first storage device for storing the number of pulses in correspondence with each of a plurality of gradation levels of the print dot to be printed through the heating-elements;

a read-out device for reading out the number of drive pulses corresponding to the gradation level from the first storage device;

a second storage device for storing the number of pulses read out by the read-out device;

subtract means for subtracting 1 each from the number of drive pulses stored in the second storage device whenever the pulse application means applies the drive pulses to the heating-elements; and judgement means for judging whether or not a value obtained by the subtraction by the subtraction means is 0;

wherein the pulse application means applies the drive pulses to the heating-element until the judgement means judges that the subtracted value becomes 0.

12. A thermal recording apparatus including:

a thermal head provided with a plurality of heating-elements, the thermal head being movable in a first direction;

a drive device for selectively driving the heating-elements to generate heat;

an ink ribbon applied thereon with at least a first color ink, a second color ink, and a third color ink;

a print medium on which images are to be printed through the ink ribbon by the selected heating-elements, the print medium being fed in a second direction intersecting the first direction;

means for dividing the heating-elements into a first group of odd heating-elements and a second group of even heating-elements, and alternately driving the odd heating-elements and the even heating-elements at different time points;

a memory for storing image data corresponding to the first color, image data corresponding to the second color and image data corresponding to the third color; and control means for operating the drive device to drive one group of the first heating-element group and the second heating-element group to generate heat and, after moving the thermal head by one pitch defined by a print dot on the first direction, operating the drive device again to drive another group of the first heating-element group and the second heating-element group to generate heat, thereby to print the first color ink on the print medium based on the image data, and for operating the drive device to drive the another group that is different from the one group driven first to print the first color ink thereby to print the second color ink on positions where the first color ink has been printed on the print medium; and means for determining a second print position of the third color ink in correspondence with a position determined by the thermal head that is moved by half of one pitch of a print dot in the second direction from positions where the first and second color inks are printed.

13. A thermal recording apparatus according to claim 12, wherein the control means operates the drive device to drive the one group to generate heat in the position determined by the second print position determining means and, after moving the thermal head by one pitch of a print dot in the second direction, operating the drive device again to drive the other group, which was not driven previously, thereby to print the third color ink based on the image data on the print medium.

* * * * *